US007435159B2

(12) United States Patent
Bunce

(10) Patent No.: US 7,435,159 B2
(45) Date of Patent: Oct. 14, 2008

(54) ROTARY JIG

(75) Inventor: Philip Bunce, Portland (AU)

(73) Assignee: Eastland Medical Systems Ltd., West Perth, Western Australia (AU)

( * ) Notice: Subject to any disclaimer, the term of this patent is extended or adjusted under 35 U.S.C. 154(b) by 124 days.

(21) Appl. No.: 10/543,325

(22) PCT Filed: Jan. 23, 2004

(86) PCT No.: PCT/AU2004/000090

§ 371 (c)(1),
(2), (4) Date: May 12, 2006

(87) PCT Pub. No.: WO2004/065036

PCT Pub. Date: Aug. 5, 2004

(65) Prior Publication Data

US 2006/0252353 A1 Nov. 9, 2006

(30) Foreign Application Priority Data

Jan. 23, 2003 (AU) ..... 2003900366
Nov. 10, 2003 (AU) ..... 200306182
Nov. 13, 2003 (AU) ..... 2003906246

(51) Int. Cl.
*B21G 1/12* (2006.01)

(52) U.S. Cl. ..... 451/11; 451/229; 451/382

(58) Field of Classification Search ..... 451/11, 451/229, 241, 242, 246, 249, 332, 381, 382, 451/385, 387, 397, 398, 424
See application file for complete search history.

(56) References Cited

U.S. PATENT DOCUMENTS 5,495,988 A * 3/1996 Follese et al. ..... 241/36
5,501,630 A 3/1996 Samsel
5,711,701 A * 1/1998 Grinderslev et al. ..... 451/378
6,015,338 A 1/2000 Hong et al.

FOREIGN PATENT DOCUMENTS

| | | |
|---|---|---|
| CA | 961811 | 1/1975 |
| DE | 582450 | 8/1933 |
| EP | 0 591 992 B1 | 4/1994 |
| GB | 338058 | 11/1930 |

* cited by examiner

*Primary Examiner*—Jacob K. Ackun, Jr.
(74) *Attorney, Agent, or Firm*—Merchant & Gould P.C.

(57) ABSTRACT

A jig intended in use to hold a series of blanks of rod-like or wire-like form during machining, the jig having a body adapted to be mounted to a drive shaft for rotation of the body about an axis of rotation, the body having a perimeter which on rotation of the jig defines a rotation path, the perimeter being defined by a set of stations located around the rotation path, each station having a pair of opposed clamping surfaces, one side of the clamping surfaces being located at the rotation path, in use the clamping surfaces being intended to receive between themselves a set of said blanks, one end of said blanks being positioned to extend outwardly from the one side to extend beyond the rotation path. The clamping surfaces can have a cylindrical or polygonal shape and the blanks can be supported to extend in a direction transverse to the rotation path or parallel to the rotation path. A process and grinding system are also claimed.

36 Claims, 21 Drawing Sheets

ROTARY JIG

FIELD OF THE INVENTION

This present invention relates to the manufacture of elongate elements which require treatment such as machining, grinding and like treatment at one end. Such elongate items can include hypodermic needles and other small diameter components such as trephines or trocars, and more particularly to the machining of hypodermic needles and other small diameter components from blanks.

BACKGROUND

The lancing action of a hypodermic needle, often referred to as a "blade", is generally facilitated by three bevels, or facets, ground on an end portion of a tubular blank ("tube") from which the blade is formed. These typically comprise a primary facet and two secondary facets, resulting in the blade having three distinct facet intersections when viewed axially. The sharpness of the angle between these ground facets, between each facet and the blade's curved surfaces, along with other factors such as the diameter and thickness of the blade, effect the levels of patient comfort experienced in use.

Despite the number of blades being consumed by the world's populace continuously increasing over the last fifty years, the manner in which they are mass-produced has developed little in the same period. Typically a linear jig holding up to 1,000 tubes is used. The tubes are clamped between two flat plates of the jig and arranged adjacent one another such that their longitudinal axes are parallel, with one end of each of the tubes extending out from the jig in a direction orthogonal to the axis of a grinding wheel. The amount each tube extends out is governed by such factors as the tolerance of the grinding operation, the amount of material to be removed, and the tube material and dimensions.

During grinding of the blades, the jig traverses the length of the grinding wheel to progressively expose all of the tubes clamped in the jig to the grinding wheel. The primary facet is first ground adjacent the ends of all of the tubes, typically with twelve traverses of the linear jig across the face of the grinding wheel, advancing the jig closer to the grinding wheel at the completion of each traverse. Next, one of the flat plates of the jig clamping the tubes is moved relative to the other in a direction orthogonal to the longitudinal axis of the tubes to roll the tubes uniformly through a predetermined angle. This time with only two traverses across the grinding wheel, a first secondary facet is ground adjacent the end of each tube. The tubes are then further rolled about their longitudinal axes through a predetermined angle, and a further secondary facet having a shape corresponding to the first secondary facet is ground, again in two traverses.

Manufacturing blades by this process presents several difficulties. The linear jig relies on achieving parallel alignment of adjacent tubes, with the ends of the tubes between the clamping plates extending out from the jig orthogonal to the longitudinal axis of the grinding wheel, and a uniform clamping pressure being applied to all of the tubes. Precise grinding further depends on accurately rolling the tubes while maintaining this orthogonal angle of the tubes to the grinding face of the grinding wheel. Initial misalignment of the tubes results in inconsistencies between blades ground in the same and different batches, and these inconsistencies and errors are magnified when the tubes are rolled between the grinding of the different facets. This initial misalignment is both difficult to detect and to remedy, being expensive in terms of time to correct, wasted tubes and/or reduced or inadequate quality of the ground blades.

When manufacturing needles for use in certain types of safety syringes that require a slit or flat to be machined in the tube for co-operation with related structure in the body of the syringe, the slit or flat requires a precise alignment with the primary facet. Current practice for the machining of these slits or flats is to employ another operation subsequent to the grinding of the facets, wherein the blades are re-orientated for the further machining operation. This makes the machining of the slits or flats quite a time-consuming operation. This operation becomes further complicated by the need to avoid touching the ground ends of the tubes to determine the exact locations of the already ground facets, as this has the adverse effect of blunting the ground facet edges.

The conventional method of manufacturing blades using a linear jig results in the grinding wheel having wear greater at its axial end sections than at its middle section, resulting from the horizontal traverses of the jig wherein the tubes first come into contact with the wheel at the axial ends of the wheel. Hence, there is a tendency for the grinding wheels to develop a taperered sectional profile from the middle to either end of the wheels which in turn means that the grinding wheels need to be regularly dressed back to a cylindrical profile.

Further, because grinding occurs largely at the two regions adjacent the axial ends of the grinding wheel, there is a tendency for the temperature of the grinding wheel to build up at these regions, even with the substantive use of coolants. With continuous grinding, these "hot spots" can result in the grinding wheel wearing down quicker and a glazing of the grinding wheel in these regions causing possibly the burning of the blades around the regions of the ground facets, and necessitating further dressing of the wheel thus reducing the life of the wheel.

Typically, for each batch of tubes sixteen traverses of the longitudinal length of the grinding wheel by the linear jig are required for grinding the primary and secondary facets. After each traverse of the linear jig across the grinding wheel the linear jig must be stopped and restarted in the opposite direction. This substantive number of traverses of the linear jig, in combination with the stop/start nature of these traverses, makes it a relatively inefficient process.

The above description in relation to the background of the manufacture of hypodermic needles is not intended to be limiting on the scope of the invention but is merely for the purposes of enhancing an understanding of the present invention.

DISCLOSURE OF THE INVENTION

It has been determined that the use of a circular rotary jig for holding the elongate items during machining can alleviate at least some of the difficulties discussed above, and may result in significantly increased production capacity and reduced grinding wheel wear.

Accordingly the invention resides in a jig intended in use to hold a series of blanks of rod-like or wire-like form during machining, said jig having a body adapted to be mounted to a drive shaft for rotation of the body about an axis of rotation, the body having a perimeter which on rotation of the jig defines a rotation path, the perimeter being defined by a set of stations located around the rotation path, each station having a pair of opposed clamping surfaces, one side of the clamping surfaces being located at the rotation path, in use the clamping surfaces being intended to receive between themselves a set of said blanks one end of said blanks being positioned to extend outwardly from the one side to extend beyond the rotation path.

According to a preferred feature of the invention, two or more stations are arranged around the axis of the jig.

According to a preferred feature of the invention, the inner and outer clamping surfaces are provided by radially inner and outer clamping shoes.

According to a preferred feature of the invention the inner and outer clamping surfaces with the blanks clamped therebetween are capable of relative displacement between each other to thereby cause each blank to rotate about its axis to present a different part of the surface of the blank for machining.

According to a preferred feature of the invention the inner clamping surface is mounted within the jig for radial movement relative to the outer clamping surface to effect clamping of the blanks between the opposed clamping surfaces. According to a preferred feature of the invention, the inner clamping surface is provided by an inner shoe and said inner shoe is displaceable radially to effect said clamping. According to a preferred feature of the invention said inner shoe is removable from the jig to permit loading of the blanks onto the inner clamping surface. According to an alternative preferred feature of the invention the outer clamping surface is provided by an outer shoe and said outer shoe is displaceable radially to effect said clamping. According to a preferred feature of the invention, the outer shoe is may be removable from the jig for loading with blanks onto the outer clamping surface. According to a preferred feature of the invention the inner and/or outer shoes are capable of relative angular dispacement with respect to each other to effrect said clamping.

According to a preferred feature of the invention, the blanks are temporarily held to one or the other clamping surface during loading into the jig by being adhesively held to be retained thereon until the shoe has been loaded into the jig and clamping pressure is applied. The co-operation between the arcuate clamping surfaces of the two shoes during clamping will inherently correct any slight axial misalignment of the blanks which may have occurred during initial loading.

According to a preferred feature of the invention the inner and outer clamping surfaces are of arcuate form centred on the axis of rotation of the jig for clamping the blanks therebetween so that the blanks extend with their axis in the direction of the axis of rotation of the jig, the jig being indexible by rotation about its axis to present successive blanks for machining.

According to a preferred feature of the invention the inner and outer clamping surfaces with the blanks clamped therebetween are capable of relative rotational displacement between each other to thereby cause the rotateion of each blank about its axis to present a different part of the surface of the blank for machining.

According to a preferred feature of the invention the surface jointly defined by the clamping surfaces is cylindrical whereby the axes of the blanks clamped therebetween will extend parallel to the axis of rotation of the jig. According to alternative preferred features of the invention the surface jointly defined by the clamping surfaces may be conical whereby the axes of the blanks clamped therebetween will have an inclination relative to the axis of the jig.

According to a preferred feature of the invention the inner clamping surface is capable of angular displacement relative to the outer clamping surface about the axis of rotation of the jig in order to effect the rotation of the blanks clamped between the two shoes, this rotation being about the axis of each respective blank. According to a preferred feature of the invention the relative angular displacement between the clamping surfaces is effected jointly. Alternatively the relative angular displacement of one clamping surface is effected independently other clamping surface.

According to a preferred feature of the invention the jig has a perimeter of a polygonal form centred on the axis of rotation of the jig where each face is defined by having an inner and an outer clamping surfaces for clamping the blanks therebetween so that the blanks extend with their axis in the direction of the axis of rotation of the jig, the one side of each clamping surface located in a plane perpendicular to the axis and to one side of the jig, the rotation path residing in a further plane adjacent said plane, the jig in use being indexible by rotation about its axis to present the blanks on successive faces for machining. According to a preferred feature of the invention each clamping surface has a pair of opposed sides, where each side is associated with a rotation path.

According to a preferred feature of the invention the clamping surfaces are parallel to the axis of rotation whereby the axes of the blanks clamped therebetween will extend parallel to the rotation axis. According to another embodiment the clamping surfaces of the faces are convergent to jointly define a pyramid like configuration whereby the axes of the blanks clamped in the jig will have an inclination relative to the axis of rotation of the jig.

According to a preferred feature of the invention, the clamping surfaces are supported in the jig to be capable of relative tangential displacement with respect to the axis of rotation of the jig and parallel to each other, in order to effect the rotation of the blanks clamped between the two shoes about the axis of each respective blank. According to a preferred feature of the invention the relative tangential displacement between the clamping surfaces is effected jointly. Alternatively the relative tangential displacement of one clamping surface is effected independently other clamping surface.

According to a preferred feature of the invention said one side extends axially across the perimeter at each station. According to a further preferred feature of the invention the surfaces are inclined inwardly from the perimeter. According to a further preferred feature of the invention the blanks are to be supported between the clamping surface such that their main axes are parallel with a plane containing the rotation path.

According to another aspect the invention resides in a jig intended in use to hold a series of blanks of rod-like or wire-like form during machining, said jig having a body adapted to be mounted to a drive shaft and having a perimeter which on rotation of the jig defines a rotation path, the perimeter being defined by a set of stations located at angularly spaced intervals around the rotation path, each station having a pair of opposed clamping surfaces said surfaces having one side located in the rotation path, said one side extending axially across the perimeter, the surfaces being inclined inwardly from the perimeter, in use the clamping surfaces being intended to receive a set of said blanks which are positioned such that their main axes are parallel with a plane containing the rotation path, in use the outer end of said blanks being positioned to extend outwardly from the one side to extend beyond the rotation path.

According to a preferred feature of the invention the clamping faces surfaces are capable of axial displacement relative to each other whilst in their clamping mode to cause rotation of the blanks about their central axis. According to a preferred feature of the invention at least one of said clamping surfaces is defined by a removable shoe which is adapted to receive the set of blanks.

Accordingly, another aspect of the invention provides a process for grinding facets on blanks for forming hypodermic needles, comprising loading the blanks into a rotary jig as defined above, indexing the jig by rotation about its axis to present successive blanks held thereby to a grinding wheel to grind one facet on the needle, and actuating the jig to cause rotation of each blank about its axis to facilitate grinding of another facet on the blank as each blank is successively presented to the grinding wheel upon indexing of the rotary jig.

According to yet another aspect of the invention there is provided a grinding system having a rotary jig as defined above and a grinding wheel, wherein the wheel is of elongate form, the jig is mounted for movement in a direction parallel to the axis of the wheel for reciprocatory movement along the length of the wheel, and the jig is also mounted for movement transversely to the axis of the wheel.

According to yet another aspect of the invention there is provided a grinding system, comprising a rotary jig as defined above, and a grinding wheel mounted on a head which is movable relative to the jig to grind one end portion of each of the blanks projecting from the jig in a circular array. The grinding wheel can approach the blanks from the outside of the array and/or from the inside of the array.

Advantageously the head also carries a second grinding wheel locatable by movement of the head to grind a second end portion of the blanks carried by the rotary jig.

The rotary jig is not restricted just for use in grinding blanks for forming hypodermic needles, but also has more general applicability for use in machining blanks for other uses, such as surgical lances, trephines or trocars. In addition the invention can have application to the machining of any form of elongate element and need not be restricted to the production of items intended for medical use. Machining operations which can be carried out while the blanks are held by the jig and such machining activities can include for example, grinding, laser cutting, waterjet cutting and milling.

The invention will be more fully understood in the light of the following description of several specific embodiments.

BRIEF DESCRIPTION OF THE DRAWINGS

The description is made with reference to the accompanying drawings, of which.

DETAILED DESCRIPTION OF SPECIFIC EMBODIMENTS

Figure 1:
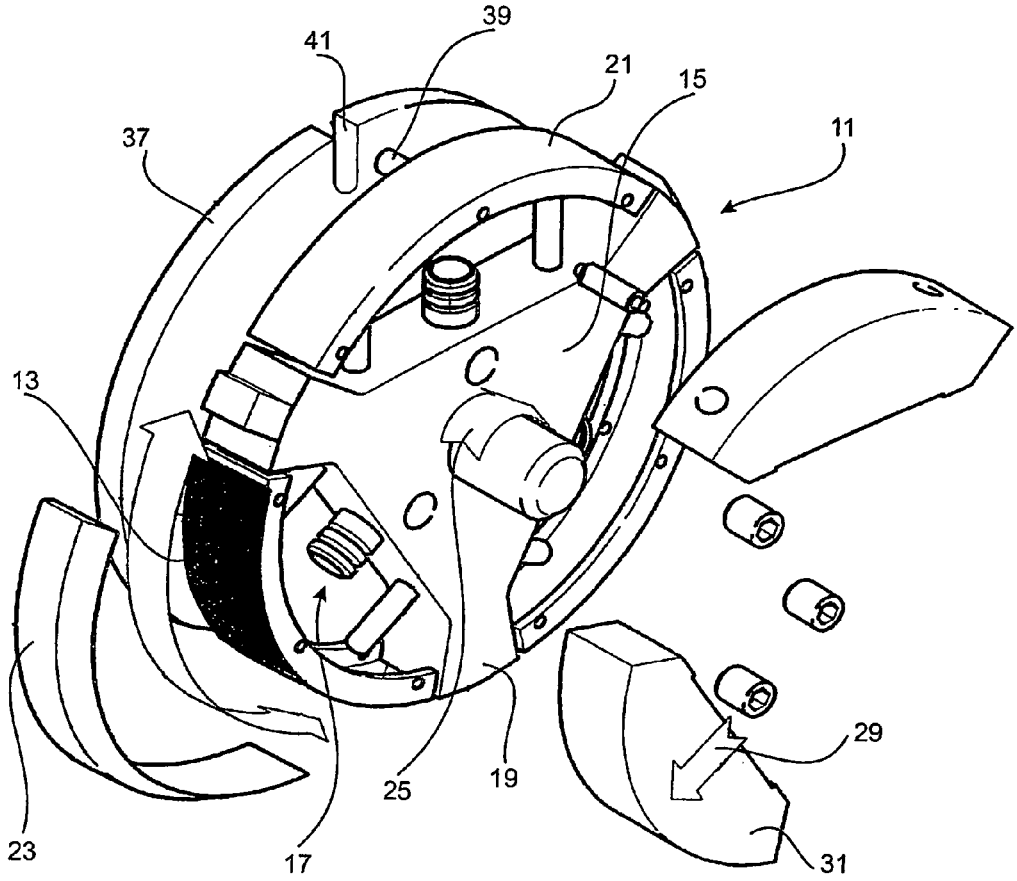
FIG. 1 is an exploded perspective view of a rotary jig according to the first embodiment of the present invention.
Figure 2:
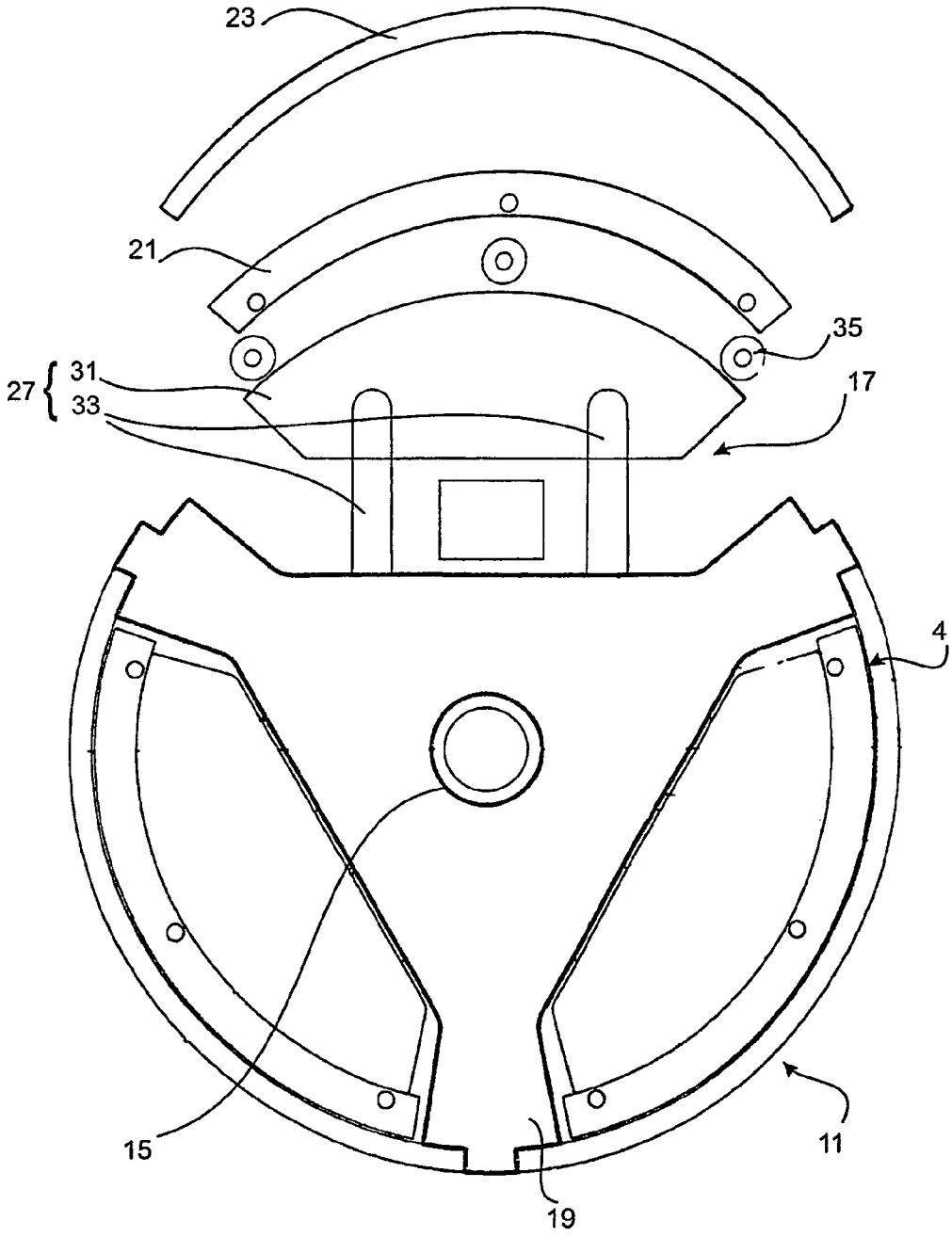
FIG. 2 is an exploded axial view of the rotary jig of FIG. 1.
Figure 3:
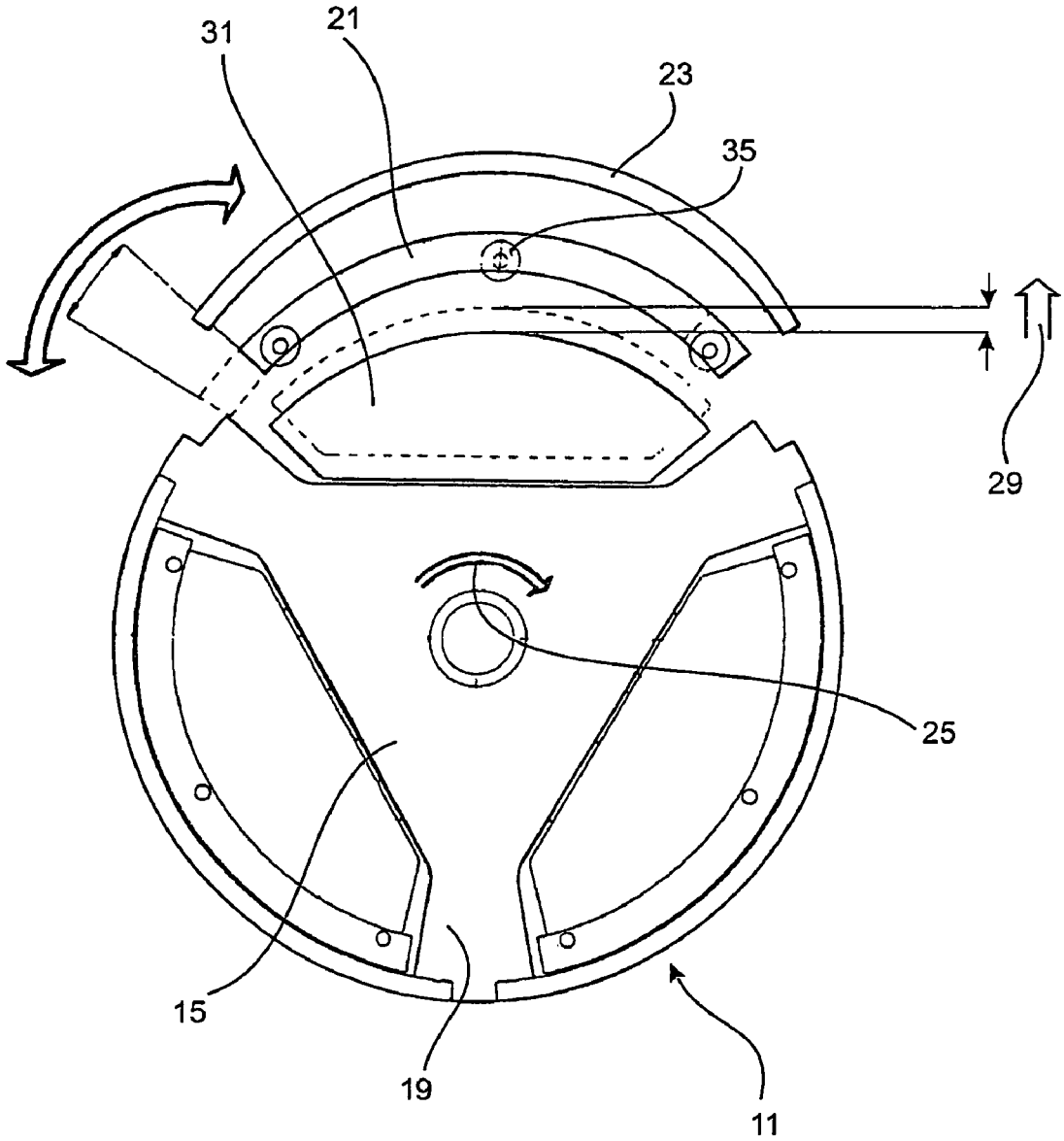
FIG. 3 is an exploded axial view of the rotary jig of FIG. 1, indicating schematically the range of movements of various parts of the rotary jig.
Figure 4:
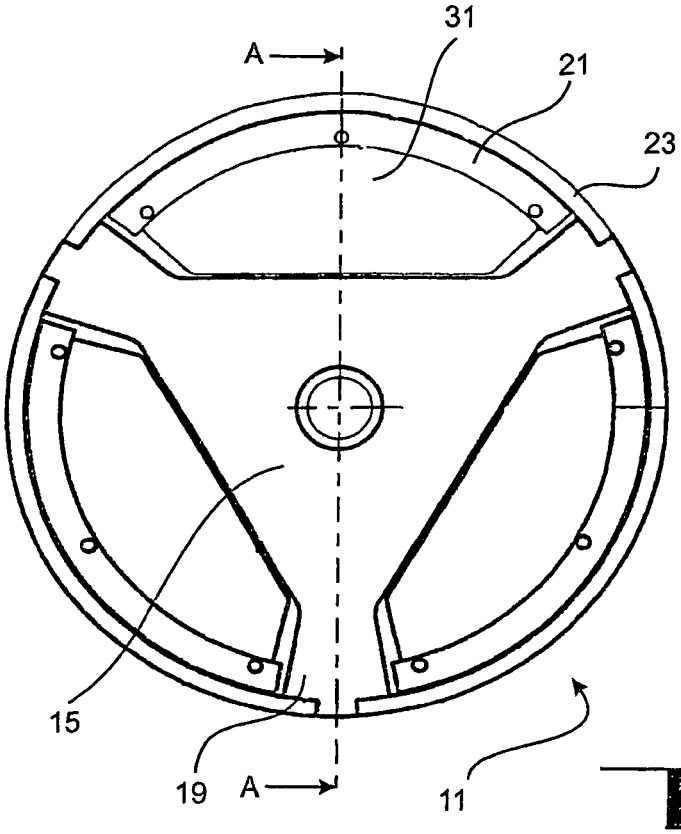
FIG. 4 is an axial view of the rotary jig of FIG. 1.
Figure 5:
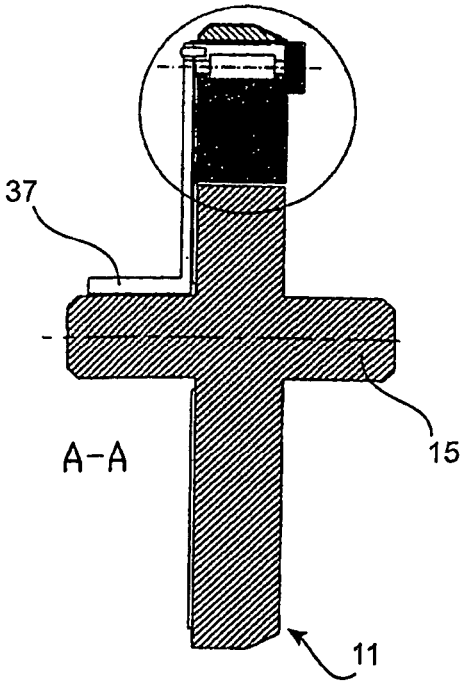
FIG. 5 is a cross-section view of the rotary jig of FIG. 4 along A—A.
Figure 6:
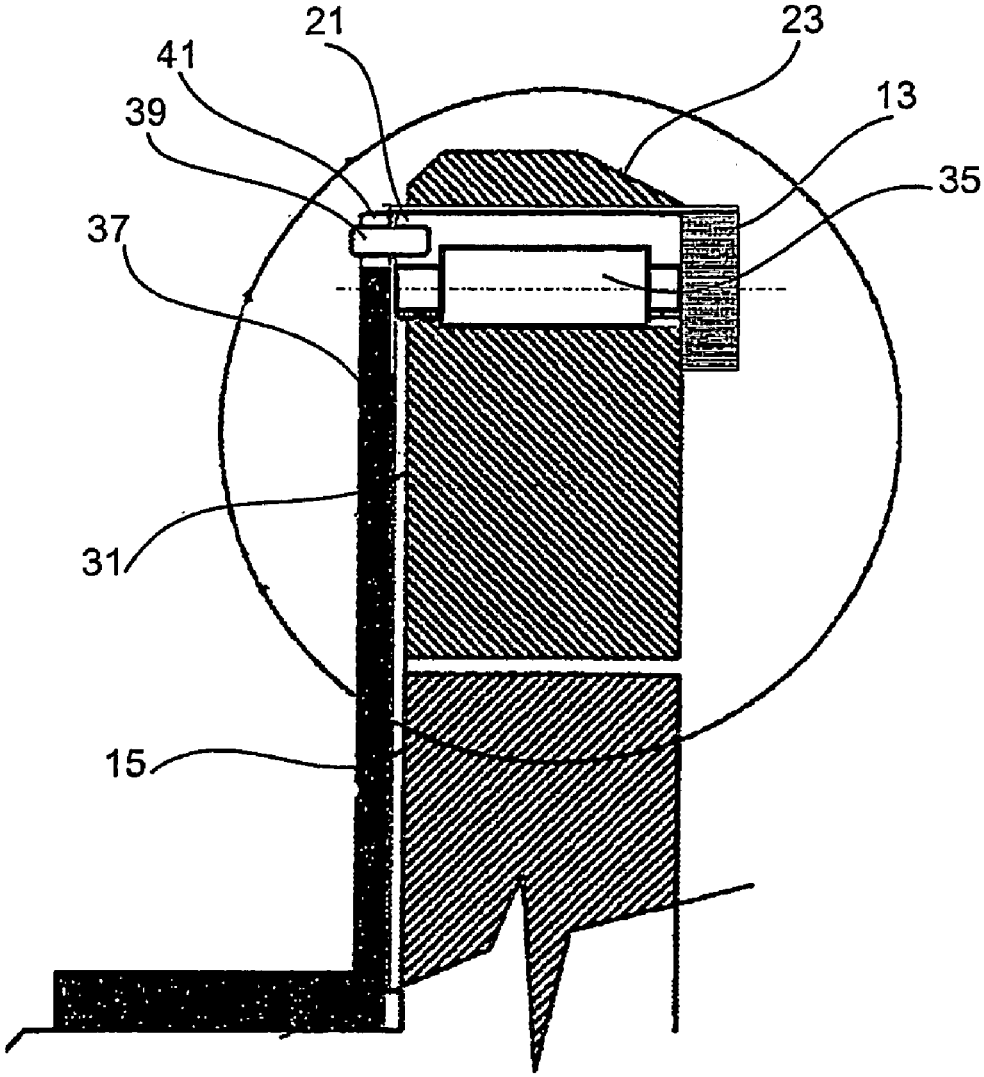
FIG. 6 is a magnified view of Detail A of FIG. 5.
Figure 7:
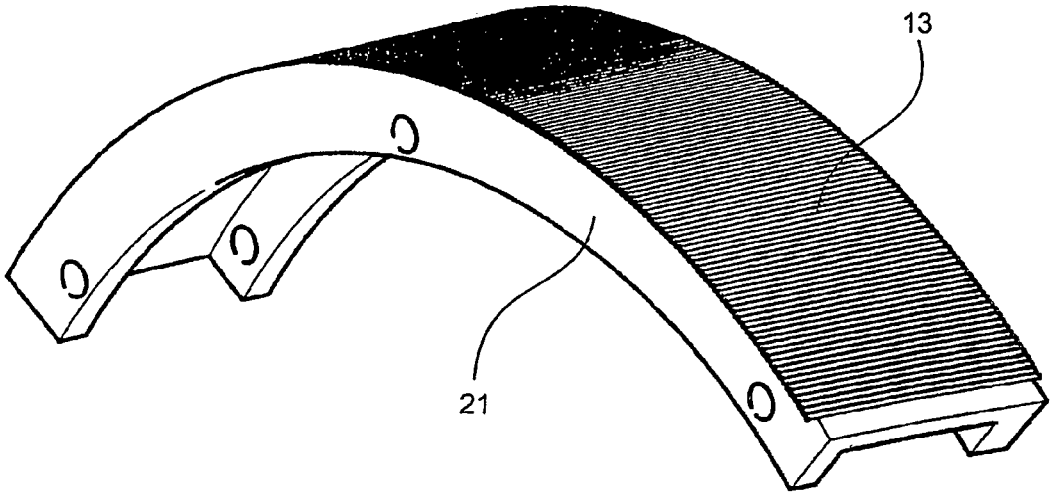
FIG. 7 is a perspective view of an inner clamping shoe according to the first embodiment of the present invention, having a plurality of adjacent axially aligned tubes adhered to its outer surface.

The first embodiment as shown in FIGS. 1 to 7 is directed to a rotary jig 11 for holding tubes 13, of which at least one of the axial ends are to be ground to form hypodermic needles or blades.

The rotary jig 11 comprises a central rotary support or mandrel 15 having three angularly displaced clamping sections 17 defined between three equally spaced radially extending arms 19. Each clamping section comprises an inner 21 and outer clamping shoe 23 with opposed arcuate clamping surfaces concentric with the axis of rotation (indicated by the arrow 25) of the mandrel 15, and a clamping mechanism 27 actuable to displace the inner clamping shoe 21 radially outwardly (indicated by the arrow 29) and inwardly relative to the outer clamping shoe 23. As shown, each clamping mechanism 27 comprises a clamping plate 31, actuators 33 for displacing the clamping plate 31 radially outwardly and inwardly relative to the axis of rotation of the mandrel 15, and rollers 35 at the outer arcuate peripheral surface of the clamping plate 31 to facilitate a rotational movement of the inner clamping shoe 21 relative to the clamping plate 31.

While the rotary jig 11 shown in FIGS. 1 to 7 has three clamping sections 17, the number of clamping sections 17 may be other than three, for example, two, four, or more clamping sections 17.

The three outer clamping shoes 23 circumferentially span between the ends of the three radially extending arms 19. The outer clamping shoes 23 may be connected to the outer ends of the radially extending arms 19 in any convenient manner; alternatively the outer clamping shoes 23 may be formed integrally with the mandrel 15 and radially extending arms 19 by machining the same workpiece.

The clamping plates 31 act to force the inner clamping shoes 21 towards the outer clamping shoes 23 so as to clamp the tubes 13 previously loaded onto the inner clamping shoes 21 when removed from the rotary jig 11. The manner in which the tubes 12 are loaded onto the inner clamping plates 21 will be described subsequently. To load the inner clamping shoes 21 into the rotary jig 11, the clamping plates 29 are retracted inwardly towards the axis of rotation of the mandrel 15. The inner clamping shoes 21 with a series of tubes 12 adhered to their outer surfaces, and extending parallel to the axes of rotation of the jig 11, are then positioned within the clamping sections 17. The clamping mechanisms 27 are then re-engaged to drive the clamping plates 29 radially outwardly, to force the inner clamping shoes 21 toward the outer clamping shoes 23, and thereby clamp a series of tubes 13 there between in preparation for machining as will be subsequently described.

On one axial side of the mandrel 15 there is mounted a plate 37 that may be selectively oscillated about the axis of rotation of the mandrel 15 rotationally to displace the inner clamping shoes 21 relative to the outer clamping shoes 23, and thereby to roll the clamped individual tubes 13 about their axes to enable grinding of the different facets. For this purpose the inner clamping shoes 21 have locating lugs 39 that engage with substantially radial slots 41 at the periphery of the oscillating plate 37, such that the rotary movement of the inner clamping shoes 21 about the axis of rotation of the mandrel 15, and relative to the same, corresponds to the movement of the oscillating plate 37.

Figure 8:
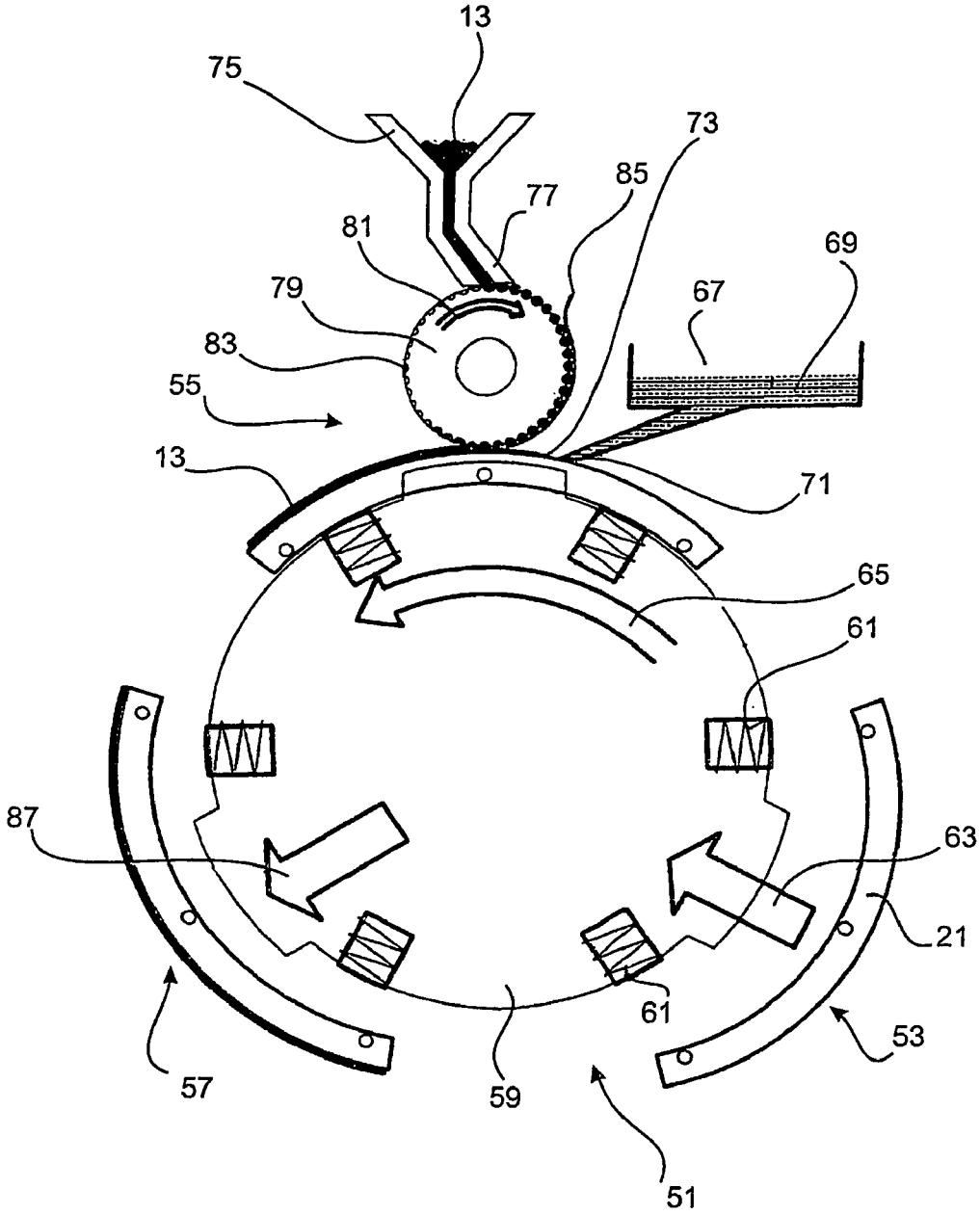
FIG. 8 shows a tube loading station according to first embodiment of the present invention.

One suitable form of a loading station 51 for loading tubes 13 onto an inner clamping shoe 21 removed from the rotary jig 11 is shown in FIG. 8. The tube loading station 51 comprises three substations 53, 55, 57. In FIG. 8 at

- substation one, 53 an inner clamping shoe 21 at that station is being loaded onto a rotating main turret 59;
- substation two, 55 tubes 13 are being applied to the inner clamping shoe 21; and
- substation three, 57 the inner clamping shoe 21 with the tubes 13 temporarily adhered to its outer surface is unloaded from the loading station 51.

Advantageously, the operations at these three substations 53, 55, 57 occur concurrently.

At substation one 53, an inner clamping shoe 21 is loaded onto the main turret 59, and is engaged and held on the turret by a suitable retention means such as by electromagnets 61, as indicated by the arrow 63. At substation two 55, the rotation of the main turret 59 (in the direction indicated by the arrow 65) moves the inner clamping shoe 21 past a first hopper 67 filled with an adherent 69, such as for example, a water based or other soluble gel or glue. As the inner clamping shoe 21 passes an outlet 71 of the hopper 67 a thin layer 73 of adherent is formed on the outer peripheral surface of the inner clamping shoe 21. As the main turret 59 further rotates, the inner clamping shoe 21 moves past a second hopper 75 filled with tubes 13 which are all axially aligned with the axis of rotation of the main turret 59. The outlet 77 of this second hopper 75 releases tubes 13 onto a tube feeder turret 79 that rotates in an opposing direction (as indicated by the arrow 81) to the main turret 59, with which it is axially aligned. The peripheral surface of the tube feeder turret 62 is formed with a series of axial recesses 83 which are configured to receive the tubes 13 from the outlet 77 of the second hopper 75 and to maintain the axial alignment of the tubes 13. As the tube feeder turret 79 rotates, a guard 85 prevents the tubes 13 from prematurely dislodging from the recesses 83 under the force of gravity until the tubes 13 come into contact with the outer peripheral surface of the inner clamping shoe 21 (with the adherent layer 73 formed thereon) at the convergence of the rotation path of the tube feeder turret 79 with the rotation path of the main turret 59. The adherent layer 73 holdps the tubes 13 onto the outer surface of the inner clamping shoe 21, maintaining the alignment and spacing of adjacent tubes 13 thereon.

At substation three 57, the inner clamping shoe 21 with adjacent axially aligned tubes 13 adhered thereto is released from the main turret 59 by the electromagnets 61, as indicated by the arrow 87.

The inner clamping shoes 21 with the tubes 13 adhered to the outer surfaces thereof are then loaded into the rotary jig 11. The clamping plates 31 of the clamping mechanism 27 are then moved radially outwardly against the inner clamping shoes 21 towards the outer clamping shoes 23 as described above, thereby clamping the tubes 13 between the inner 21 and outer clamping shoes 23. The co-operation between the tubes 13 and the matching arcuate surfaces of the inner 21 and outer clamping shoes 23 ensures that when the inner clamping shoes 21 are brought into clamping engagement with the outer clamping shoes 23, the tubes 13 align into exact axial alignment and thereby correct any slight misalignment which might occur during loading of the tubes 13 onto the inner clamping shoes 21. While this process has only been described schematically, it lends itself, like all of the described embodiments, conveniently to a high degree of automation.

The use of a water based or other soluble gel or glue as an adherent, facilitates the use of a suitable solvent such as water for the removal of the ground tubes 13 to wash the adherent from the inner clamping shoes 21 into a capture basket (not shown), where the blades 72 can be sieved from the resulting adherent solution. Advantageously the adherent could be recycled from the adherent solution and reused.

Alternatively to the above, two strips of tacky material (not shown) could be fixed to the abutting surfaces of each pair of inner and outer clamping shoes 21 and 23 to hold the axially aligned tubes 13 in position prior to and subsequent to clamping. After grinding, the tacky material could be re-activated for use after stripping the blades 13 off the inner clamping shoes 21 with the use of either water or another solvent to ready the tacky material for reuse.

Two different grinding machines, both incorporating the use of a rotary jig according to the first will now be described.

Figure 9:
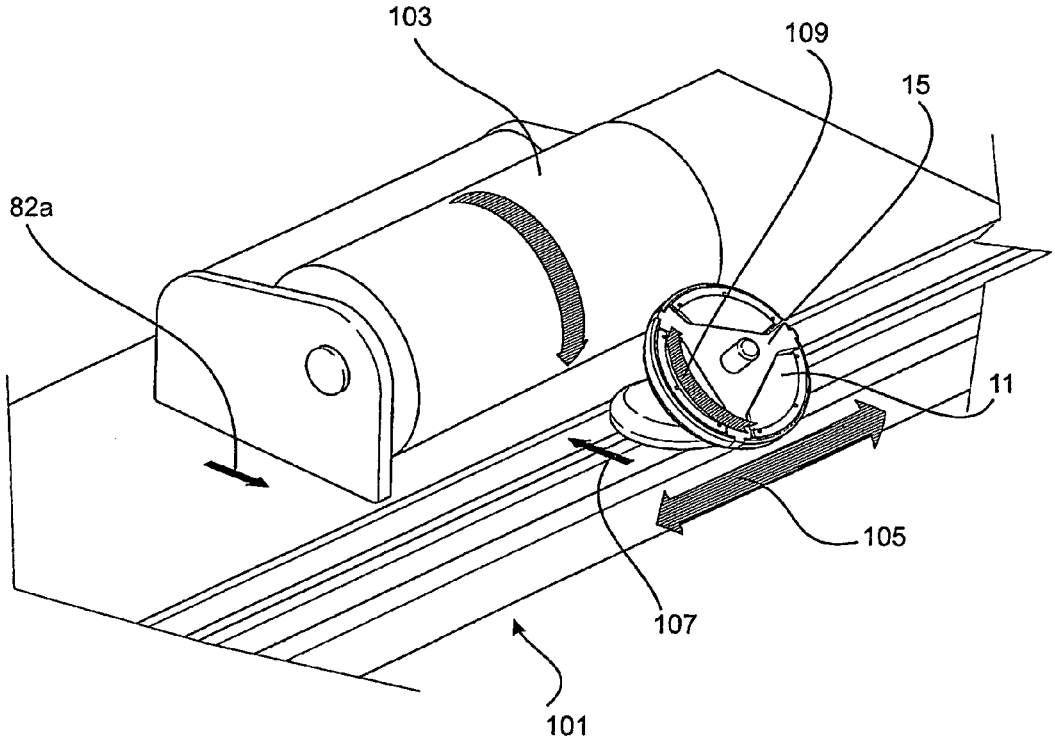
FIG. 9 is a perspective view of a grinding machine incorporating the rotary jig according to the first embodiment of the present invention.

FIG. 9 illustrates a grinding arrangement comprising a grinding machine 101 for grinding facets on tubes 13 utilising the rotary jig 11 according to the first embodiment. The grinding machine 101 comprises a cylindrical grinding wheel 103, which is similar to those used with existing linear jigs as previously discussed. The rotary jig 11 for example, supports a number of tubes 13 (of the order of 1000) in readiness for grinding in the machine. In grinding the tubes the jig 11 moves substantially along two axes comprising, a first axis (indicated by the arrow 105) which is parallel to to the central axis of grinding wheel, and is caused to reciprocate in both the directions along the first axis, and a second (indicated by the arrow 107) which is substantially normal to the central axis of the grinding wheel along which the tubes are moved relative to the wheel towards the grinding wheel 76 as the tubes are being ground. The movement along the second axis can be effected by movement of the jig 11 towards the wheel 103 or alternatively by the movement of the wheel towards the jig 103 in the directions 109 or 109A respectively. As the rotary jig 11 traverses the length of the grinding wheel 103, the rotary jig 11 is also indexed by rotation of it's mandrel 15 in the direction 109 so as to present successive tubes 13 to the grinding wheel 103. Upon each complete revolution of the rotary jig 11 about the axis of rotation of the mandrel 15 as it traverses the length of the grinding wheel 103, the rotary jig 11 may moved relative to the grinding wheel in the direction 107 towards the grinding wheel be fed in the direction 109 or 109A respectively. Each complete revolution of the rotary jig 11 corresponds to a complete traverse of the length of the grinding wheel 103 by ae linear jig 110 of a conventional grinding machine 112, shown in FIG. 10.

When grinding blades with the grinding machine 101, the primary facets are first ground to one axial end of each of the tubes 13 supported by the rotary jig 11. As shown in FIG. 9 the rotary jig 11 traverses the length of the grinding wheel 103 in alternating directions indicated by the arrow 105 whilst, rotating about the axis of rotation of the mandrel 15 as indicated by the arrow 109. It is anticipated that the grinding the primary facets typically requires six revolutions of the rotary jig 11 (with corresponding relative advances of the rotary jig 11 towards the grinding wheel 103 in the direction indicated by the arrow 82 or 82A between revolutions).

The tubes 13 are then rolled about their longitudinal axes within the rotary jig 11. This is done by rotating the plate 37 of the jig 11 through a predetermined angle relative to the mandrel 15. This results in a corresponding circumferential displacement of the inner clamping shoes 21 relative to the outer clamping shoes 23. This relative movement of the inner clamping shoes 21 with respect to the outer clamping shoes 23, results in the tubes 13 adhered to the inner clamping shoes 21, and clamped between both the inner 21 and outer clamping shoes 23, rolling about their longitudinal axes. Axial alignment of the tubes 13 is inherently maintained when the tubes 13 are rolled to facilitate the grinding or machining a subsequent face of the end of each tube 13.

By multiple rotations of the rotary jig 11 as it continues to traverse the length of the grinding wheel 103, a first secondary facet can be ground onto the tubes 13 supported by the rotary jig 11 adjacent the ends to which the primary facets have been ground. Similarly, the tubes 11 can then be again rolled in the manner described above and a second secondary facet can be ground.

Ii is a characteristic that when using the above grinding machine 101 incorporating a linear jig 110 with a fixed grinding wheel 103 the facets ground will have a planar profile when viewed axially. In contrast, the rotary motion of the rotary jig 11 according to the first embodiment as it traverses the fixed grinding wheel 103 of the grinding machine 101 results in the ground facets having a slightly convex profile when the facets are viewed axially.

Figure 10:
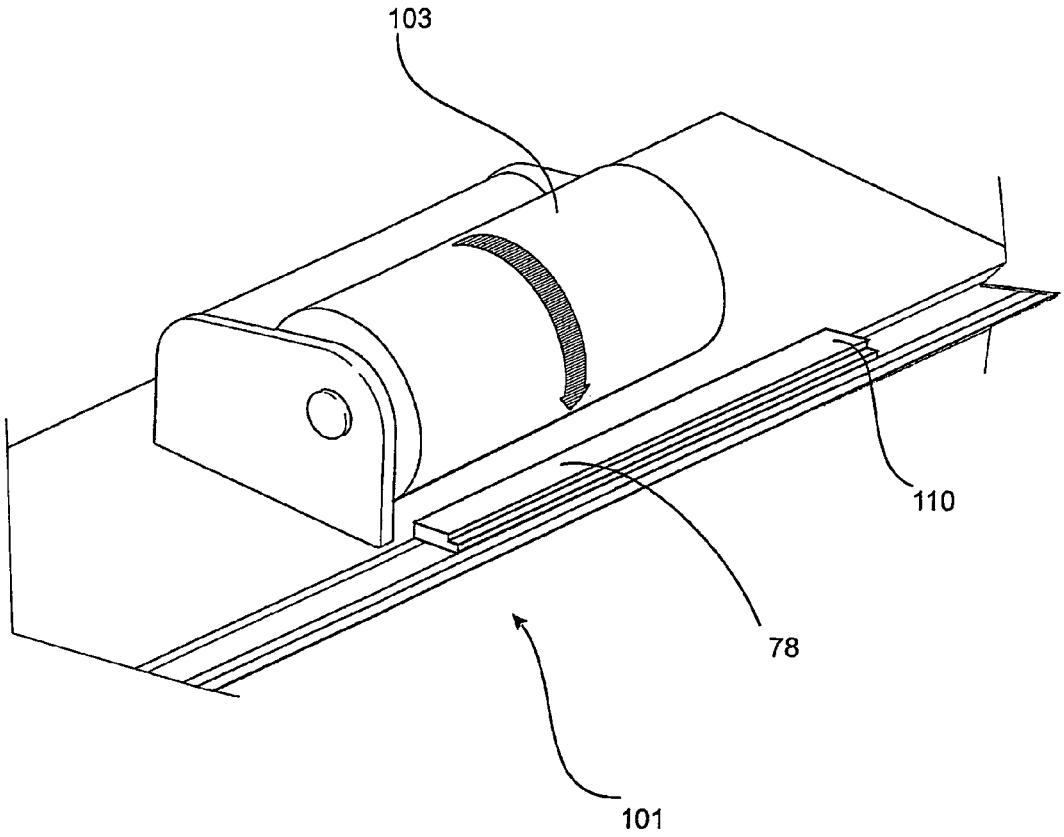
FIG. 10 is a perspective view of the previously proposed grinding machine incorporating a linear jig.

The use of a rotary jig according to the first embodiment in the grinding machine 101 of the form described above improves the efficiency of the process of grinding blades when compared to the uses of a linear jig with a similar grinding. As just explained, each time the rotary jig 11 has completed a full revolution, the rotary jig 11 can be fed toward the grinding wheel 103 to perform a subsequent grinding traverse. Therefore, if for example the rotary jig 11 rotates three times as it traverses across the grinding wheel 103, then it can advance into the grinding wheel 103 three times per traverse. In contrast, with a conventional arrangement as shown at FIG. 10 the linear jig 112 may only advance toward the grinding wheel 103 once per traverse of the length of the grinding wheel 103. If for example the grinding wheel 103 is 0.6 meters wide and the linear jig 110 is 1 meter long, the linear jig 110 will need to traverse 1.6 meters as a minimum before the linear jig 110 can advance into the grinding wheel 103 for a subsequent grinding traverse. By using the rotary jig 11, and advancing the rotary jig 11 towards the grinding wheel 103 after each revolution, with a single traverse of the length of the grinding wheel 103 plus stop/start clearances at each end, the same amount is ground as that which would be achieved with 4.8 meters of traverse (three separate traverses) plus three stop/start spaces of the linear jig 110. This would suggest that production might be increased by up to 300%.

As the rotary jig 11 traverses across the grinding wheel 103 it also advances its position relative to the wheel 76 at which each successive tube 13 starts to be ground and as a result it is anticipated that the grinding wheel 103 will wear generally evenly. In contrast in the use of a linear jig 110, grinding always starts substantially in the same place, causing the grinding wheel 103 to wear at each end as the linear jig 110 traverses first from one side and then from the other side which results in a crowned wheel (not shown) which has to be regularly dressed as discussed previously. Therefore it is anticipated that the use of the rotary jig will reduce the amount of time and material lost due to the required dressing of the wheel 103.

Additionally it is anticipated that when grinding with the rotary jig 11, the heat generated will be better able to dissipate as the point of grinding traverses across the grinding wheel 76. In addition since there is no longer the localised build up of heat which is associated with conventional grinding using a linear jig 110, the grinding speed, and therefor production rate when using a rotary jig may be increased significantly.

FIGS. 11 to 15, illustrate another a second form of grinding machine 111 incorporating a rotary jig 11 according to the first embodiment. In each instance the second grinding machine 111 comprises a shaft 113, supported from a base 115, by an upstanding mast 117 which is rotatably supported from the base 115 to be rotatable about an upright axis. The shaft extends laterally form the mast to be substantially parallel to the base 115 and the mandrel 15 of the jig 11 is supported from the shaft.

The second grinding machine 111 further comprises a machining head 119 having a driven shaft 121 which extends to either side of the machining head and supports a grinding wheel 123 at one end and a slitter blade 125 at its other end. The machining head 119 is rotatable about an upright axis and the axis of rotation of the shaft is perpendicular to the upright axis. Furthermore the mast is capable of moving transversely along any one of three perpendicular axes. The function of the slitter 125 is to grind slits or flats (if required) adjacent the axial ends of the tubes.

Figure 17:
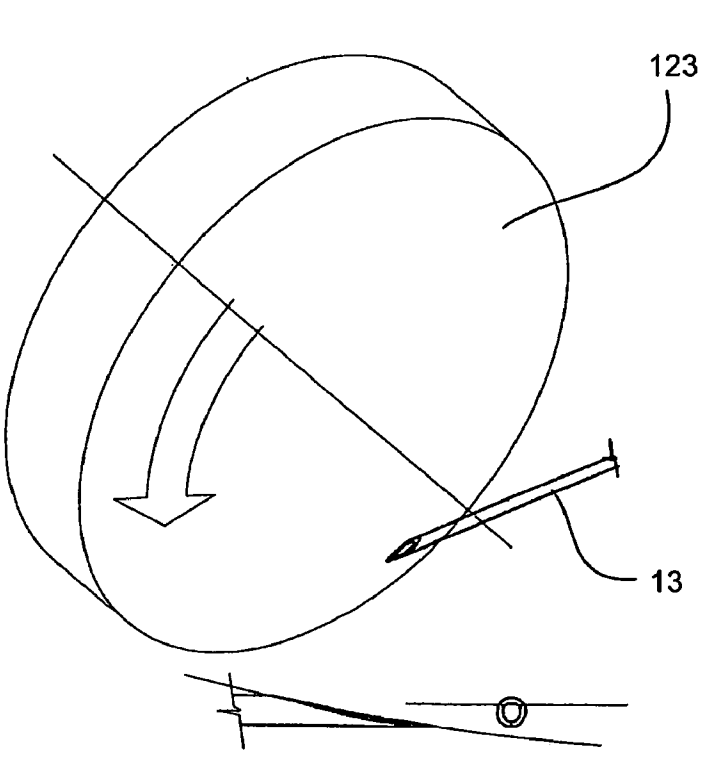
FIG. 17 shows an alternative orientation of the grinding wheel of the grinding machine of FIG. 11 relative to a blade being ground.
Figure 16:
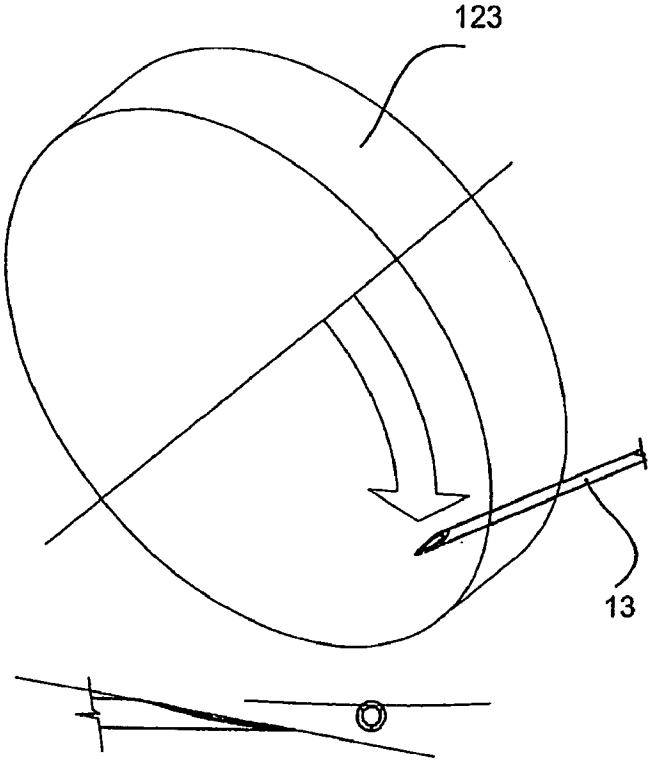
FIG. 16 shows one orientation of the grinding wheel of the grinding machine of FIG. 11 relative to a blade being ground.

While the second grinding machine 111 may grind facets on the tubes 13 held by the rotary jig 11 in a similar manner to the first grinding machine 101 described above. However, the range of axial and transverse movement of the grinding wheel 123 and the slitter 125 of the second grinding machine 111 affords significantly greater versatility. For example, FIG. 16 shows a tube 13 being ground with the axis of the grinding wheel 123 being substantially aligned with the axis of the tube while FIG. 17 shows a tube 13 being ground with the axis of the grinding wheel 123 being substantially orthogonal to the axis of the tube 13 to provide alternative profiles to the ground facets.

Figure 11:
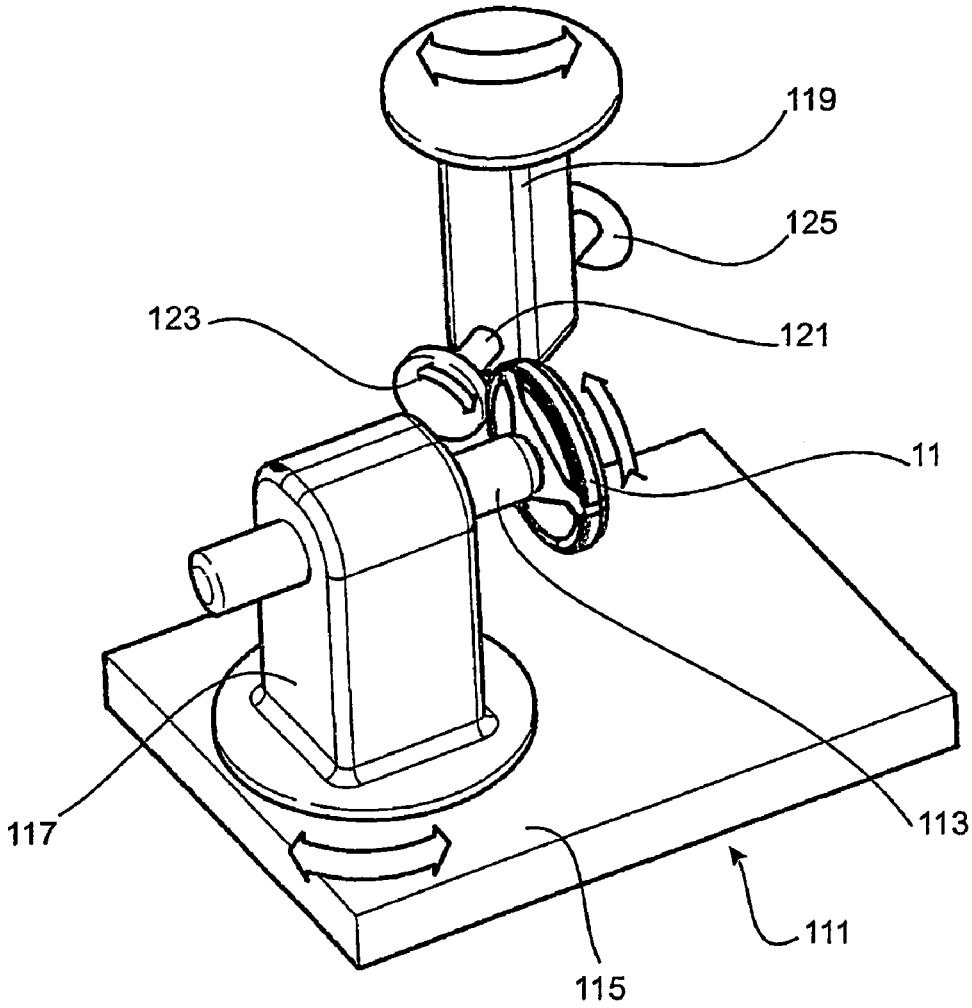
FIG. 11 is a first perspective view of a second form of a grinding machine incorporating the rotary jig according to the first embodiment of the present invention.
Figure 12:
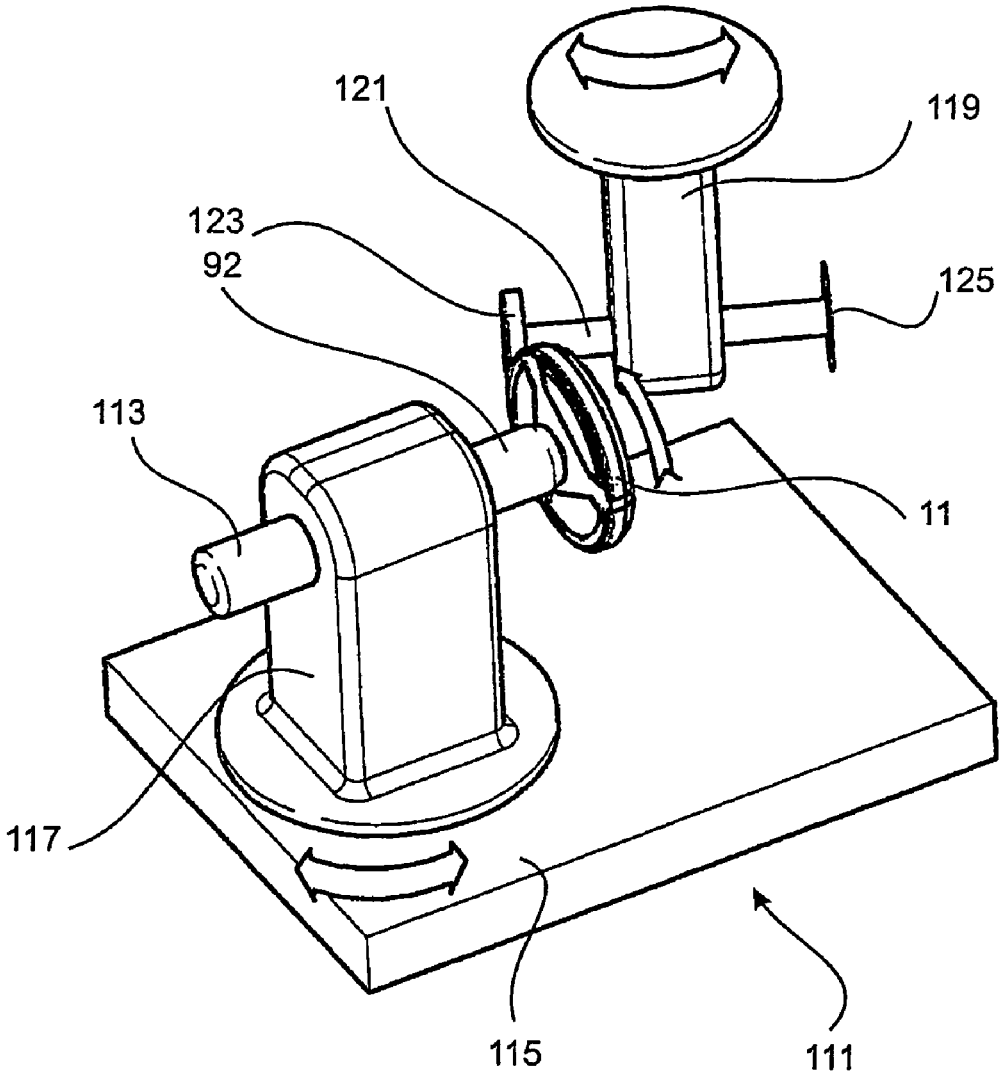
FIG. 12 is a second perspective view of the grinding machine of FIG. 11.

This selective movement of the grinding wheel 123 relative to the rotary jig 11 also allows the grinding wheel 123 to grind facets on either of the axial ends of the tubes 13 held by the rotary jig 11. FIG. 11 shows the grinding of the primary facet of a tube at the end of the tube extending inwardly towards the shaft 113 while alternatively, FIG. 12 shows the grinding of the primary facet of a tube at the end extending outwardly from the shaft 113. This is useful if it is required for example, to produce tubes with facets ground at both ends.

In another form, the second grinding machine 111 may be operated to axially grind either or both ends of the tubes 13 held by the jig 11, to provide ground tubes of a precise length.

Figure 13:
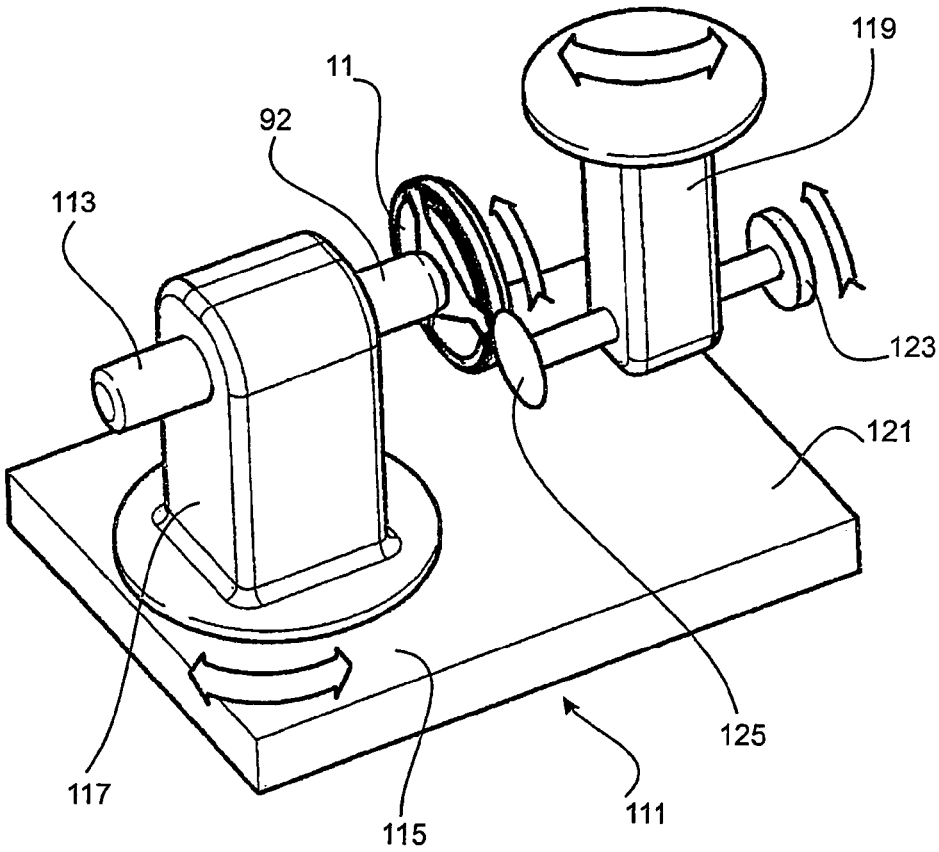
FIG. 13 is a third perspective view of the grinding machine of FIG. 11.

FIG. 13 shows the use of the slitter 125 which enables a slit or flat to be accurately ground adjacent one or both ends of the tubes, for use in a safety syringe as discussed above. As these slits or flats will ultimately be used to accurately align the ground tubes both axially and longitudinally, their positioning with respect to the ground facets at the ends of the ground tubes is paramount to their function. The second grinding machine 111 allows these slits to be accurately machined without probing, and therefor touching, the ground tubes. As the rotary jig 11 does not need to be removed from the second grinding machine 111 to perform this slitting operation subsequent to the grinding of the facets with the same machine the exact positions of the tubes are known from the previous facet grinding operations.

In FIGS. 11 and 12, the grinding of the tubes with the grinding wheel 123 positioned radially outside the circular array of axially aligned adjacent tubes 13 projecting from the rotary jig 11 is shown. As a result of this relative position of the grinding wheel 123, the facets of the tubes ground according to FIGS. 11 and 12 will have slight convex profiles when viewed axially, substantially similar to those previously discussed with reference to the tubes ground with the first grinding machine 74.

Figure 14:
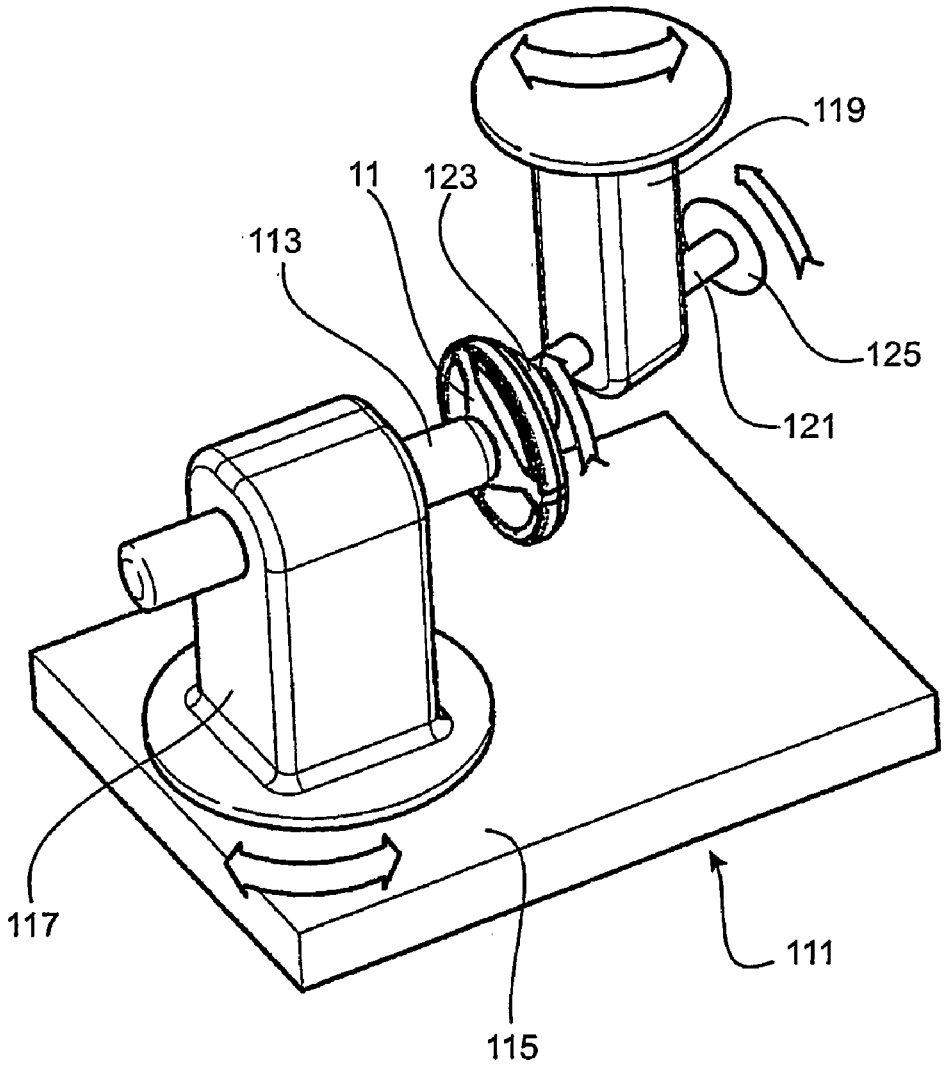
FIG. 14 is a fourth perspective view of the grinding machine of FIG. 11.

If however, as shown in FIG. 14, the tubes are ground with the grinding wheel 123 positioned radially inside the circular array of axially aligned adjacent tubes 13 projecting from the rotary jig 11, then the resultant ground facets of the ground tubes will have slight concave profiles when viewed axially. These concave profiles provide the ground tubes 72 with sharper edges between the ground facets and the blades surfaces whereby in use patient comfort is substantially enhanced.

Alternatively, the second grinding machine 111 could be used to grind tubes with facets having flat profiles, like those produced by a conventional grinding machine incorporating a linear jig. This could be achieved by holding the rotary jig 11 stationary while linearly traversing the grinding wheel 123 across the surfaces of the tubes 13.

Figure 15:
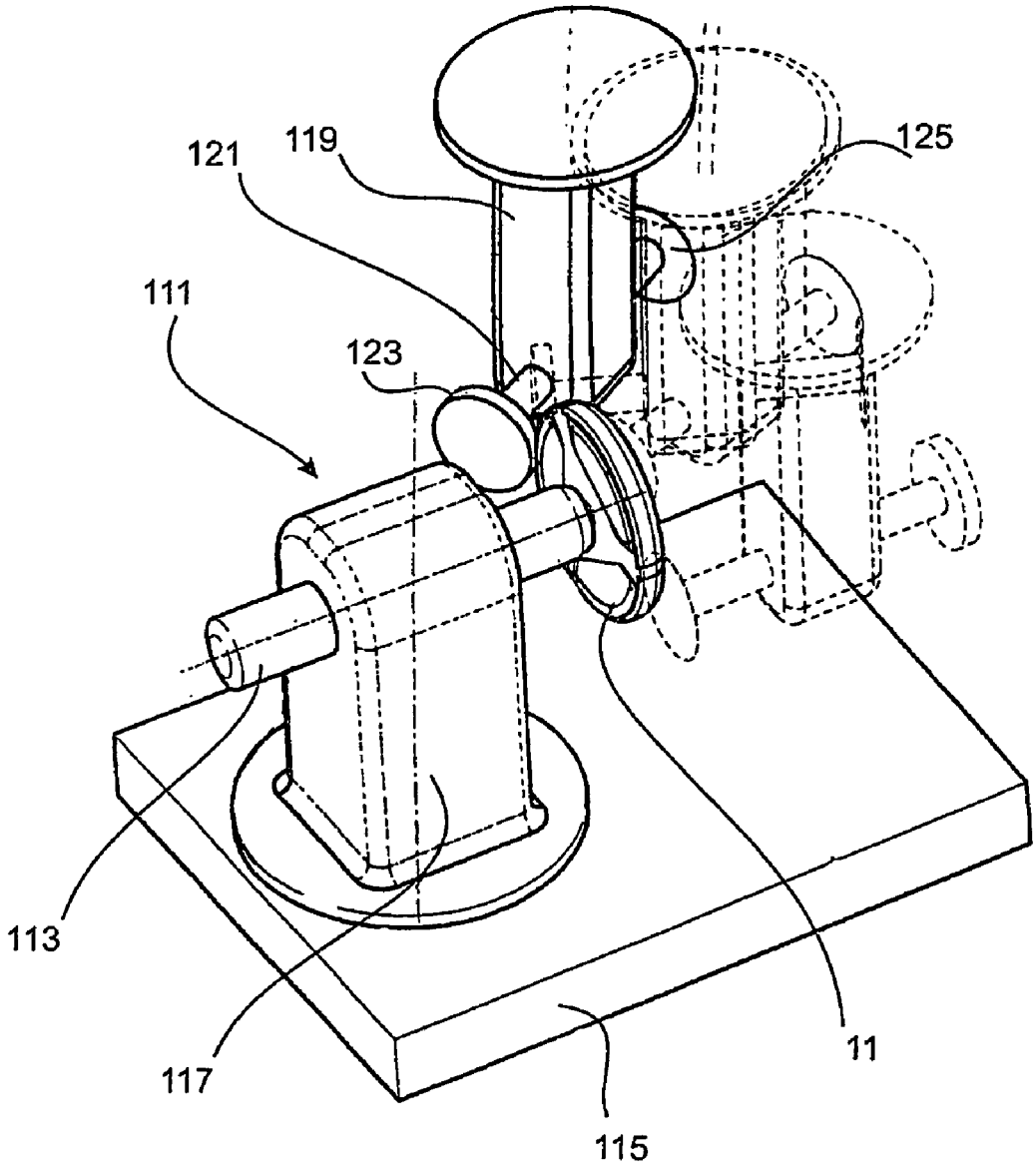
FIG. 15 is a composite view of FIGS. 11 to 14.

The ability for the second grinding machine 111 to perform all of the operations discussed above with reference to FIGS. 11 to 14, is emphasised in FIG. 15 in which FIGS. 11 to 14 have been superposed.

Figure 19:
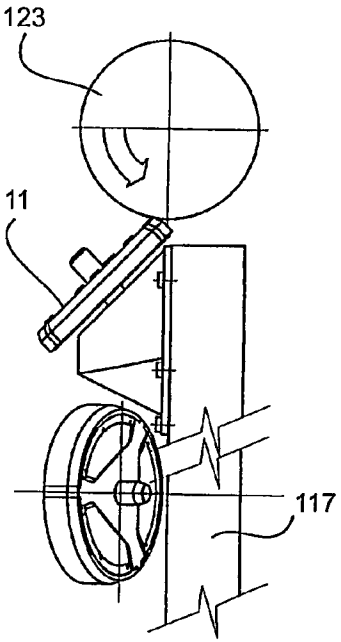
FIG. 19 is a partial side view of the carousel of FIG. 18.
Figure 18:
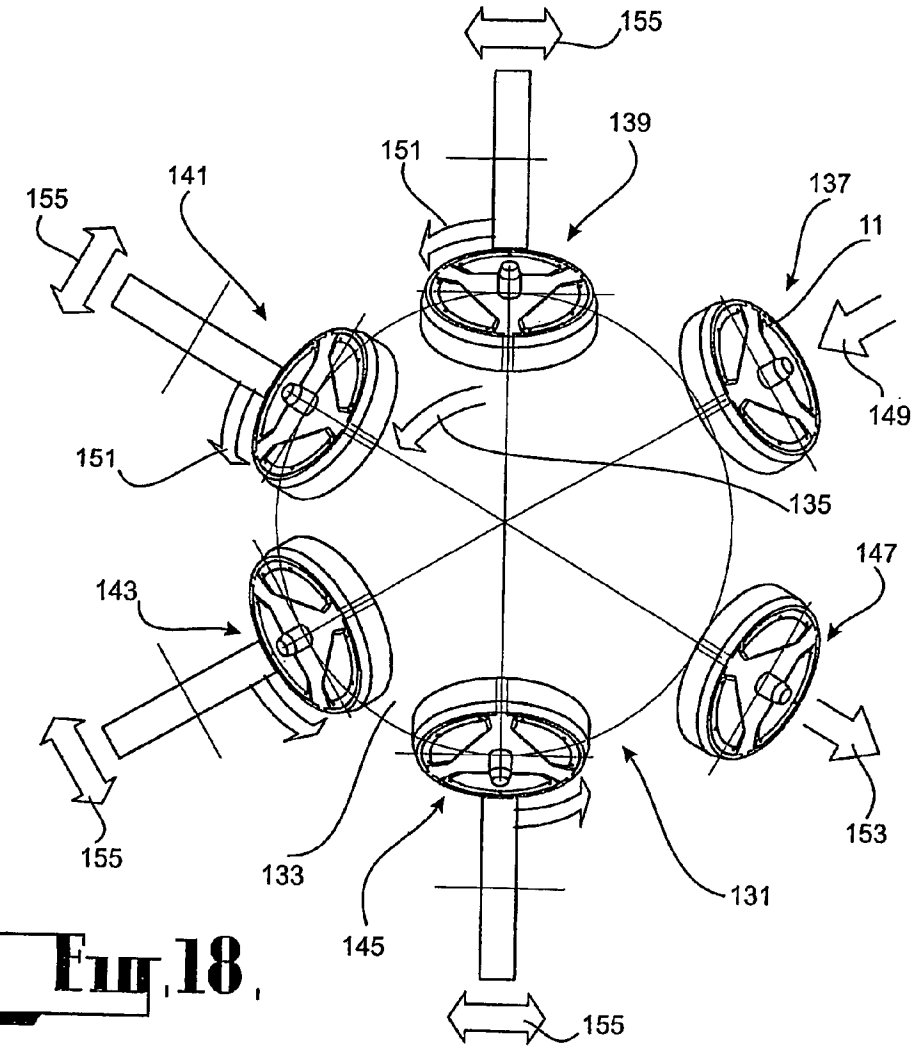
FIG. 18 is a plan view of a carousel loaded with several rotary jigs according to the first embodiment of the present invention.

As shown at FIGS. 18 and 19 the first embodiment enables the output of ground tubes to be improved upon by employing a carousel 131 loaded with several rotary jigs 11 exposed to a number of separate grinding wheels 123 located at workstations disposed at spaced inervals around the perimeter of the carousel. The rotary carousel 104 comprises a turret 133, rotating in the direction indicated by the arrow 135, holding several (6 being shown) rotary jigs 11 at equally spaced intervals about its periphery. The carousel 131 indexably rotates and stops between workstations 137, 139, 141, 143, 145 and 147 corresponding to sequentially locate each jig at each location.

In the arrangement as shown at fires 18 and 19:

at workstation one 137, a rotary jig 11 supporting a set of tubes clamped is loaded to a mast 117 on the carousel, as indicated by the arrow 149.

at workstations two 139 and three 141, the primary facet is ground adjacent one axial end of the clamped tubes 13 while the rotary jig 2 rotates (as indicated by the arrow 151) about the axis of rotation of the mandrel 15 four times at each workstations.

at workstation four 143, the clamped tubes 13 are rolled and the first secondary facet is ground.

Similarly at workstation five 145, the clamped tubes 13 are rolled again and the second secondary facet is ground.

at workstation six 147, the rotary jig 11 having the ground tubes supported, is unloaded from the mast 117 on the carousel 104, as indicated by the arrow 153.

At the second, third, fourth and fifth workstations 139, 141, 143 and 145 the grinding wheels 123 reciprocate transversally along their axes of rotation during grinding of the tubes as indicated by the arrow 155. This action moves the point of grinding along the wheels 123, thereby avoiding the creation of zones of excessive localised wear and heat build up.

It will be appreciated the grinding wheels 123 located at the second, third, fourth and fifth workstations 139, 141, 143 and 145 do not need to be all the same dimensional and/or grit size. For example, the grinding wheel 123 at the second work station 139 may be of a significantly greater grit size to facilitate increased and/or quicker material removal in comparison to the grinding wheel 123 at the third workstation 141, which may provide a finishing operation to the same facet.

It is anticipated that, existing grinding machines currently using a linear or similar jig for holding tubes may be retrofitted to incorporate the rotary jig 11 according to the first embodiment.

Figure 20:
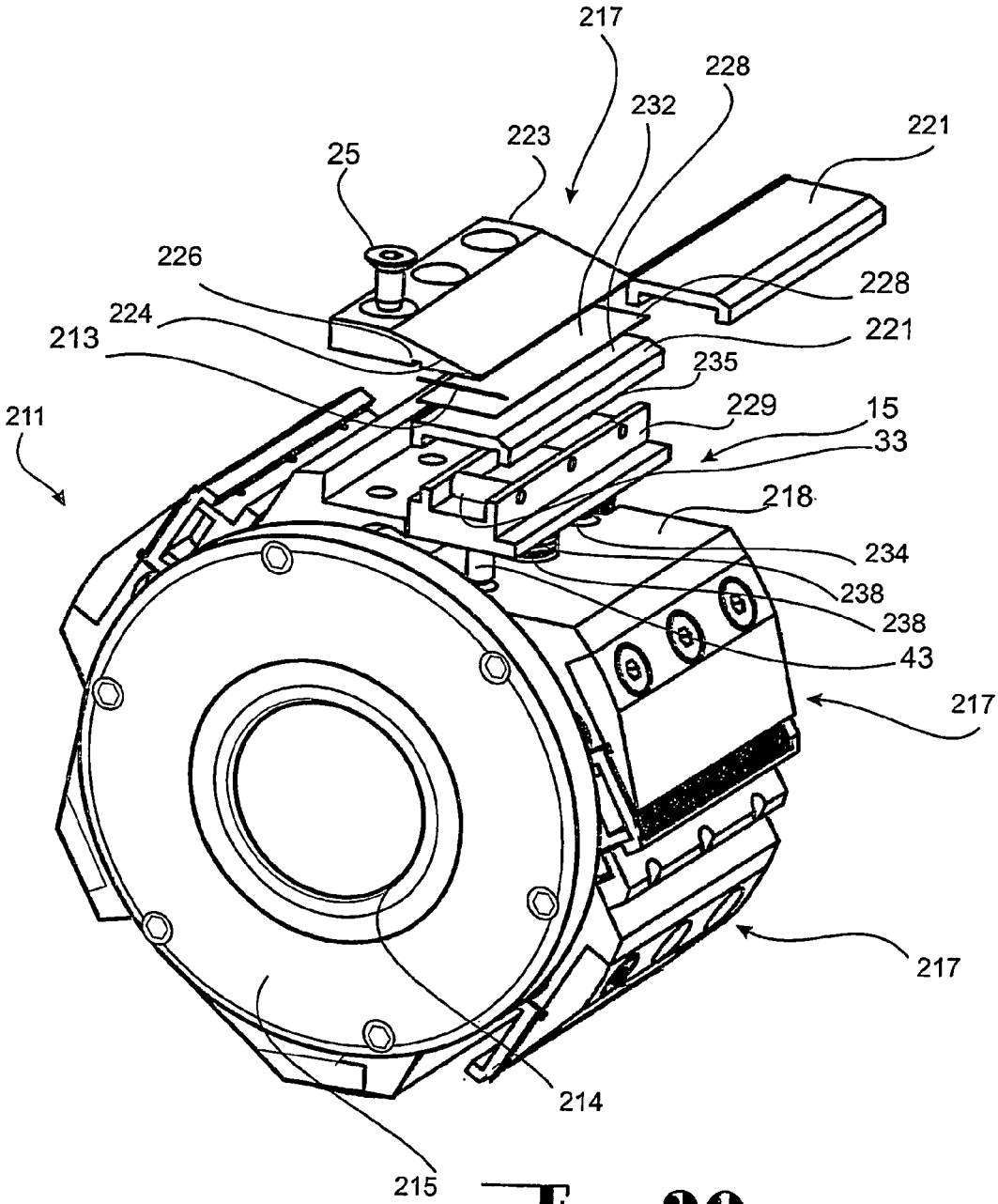
FIG. 20 is a partially exploded isometric view of a jig according to the second embodiment showing one end face.
Figure 21:
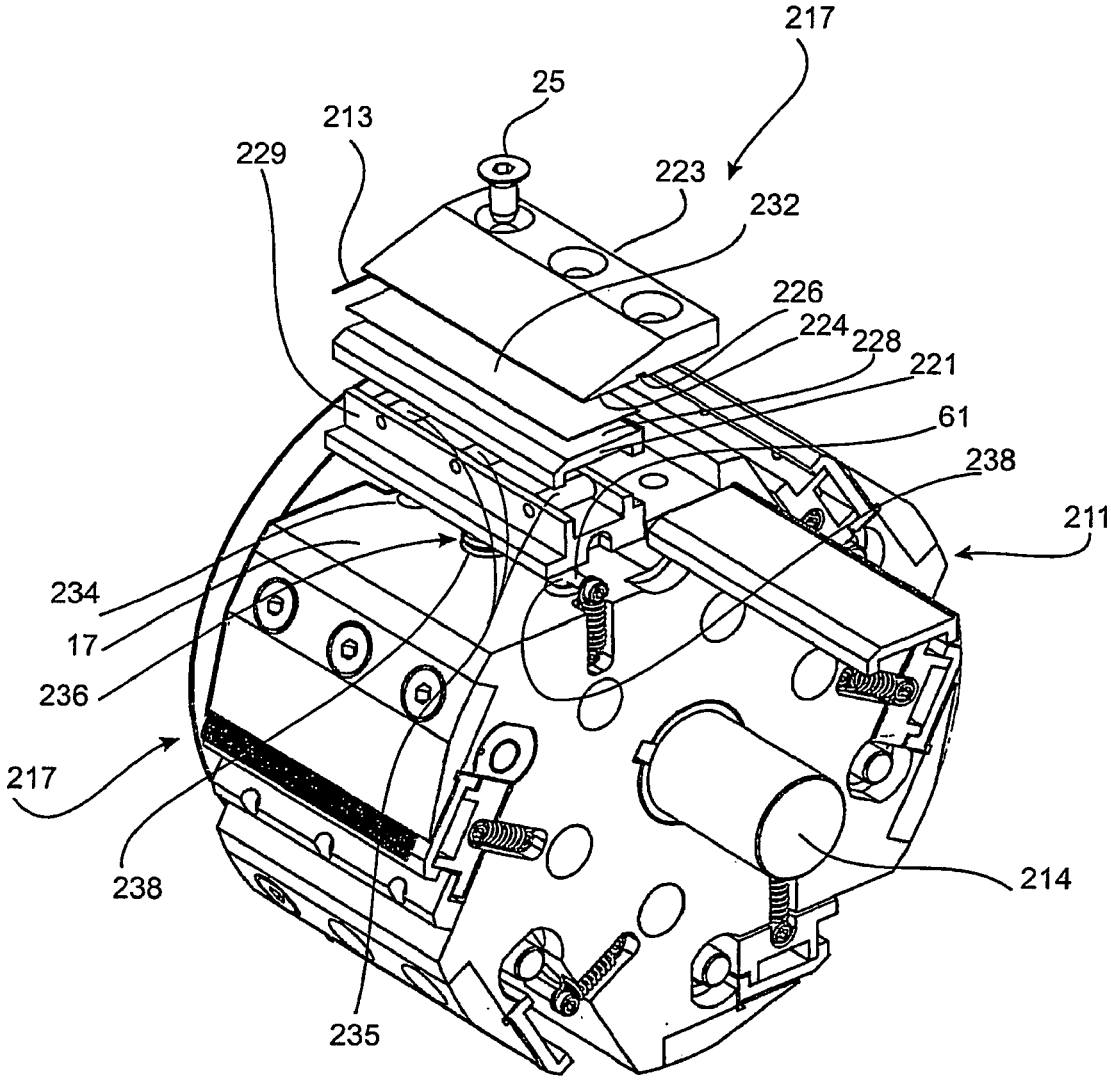
FIG. 21 is a partially exploded isometric view of a jig according to the second embodiment showing the other end face.

The second embodiment as shown in FIGS. 20 and 21 is directed to a rotary jig 211 which can be utilised in the manufacture of hypodermic needles and the like and in particular the machining and finishing of the pointed ends of those needles.

The embodiment comprises a generally cylindrically shaped body 215 which is supported from a drive shaft 214. The outer perimeter of the body 215 is generally of a cylindrical form and is defined by a set of stations which are located at angularly spaced intervals around the perimeter and which each comprise a clamping section 217 for the tubes 213 which are received in a recess 218 provided at the respective clamping section 217.

Each clamping section 217 comprises outer fixed clamping shoe 223 which is fixed to the mandrel 215 at the outer-most radial portion of the recess 218 and which when fixed to the mandrel 215 defines a portion of the outer most perimeter of the mandrel 215. The outer clamping shoe 223 is supported from the mandrel 215 to extend in a cantilever fashion across the recess 218 and has a clamping face 224 which is in opposed relation to the base of the recess 218 and which extends axially across the width of the body. The inner edge of the clamping face 224 on the outer clamping shoe 223 is defined by a groove 226 which extends axially along the length of the fixed member 19. A set of the set of screws 25 retain the outer clamping shoe 223 in position on the mandrel 215.

The clamping arrangement further comprises a inner clamping plate 229 which is supported from the base of the recess 218 in opposed relation to the clamping face 224 of the outer clamping shoe 223 and is moveable towards and away from the clamping face 224. The inner clamping plate 229 is intended to support inner clamping shoe 221 which in use is to be interposed between the inner clamping plate 229 and the outer clamping shoe 223 and defines a second clamping face 228 which is to be in opposed relation to the first clamping face 224 of the outer clamping shoe 223. The inner clamping shoe 221 is slidably received on the inner clamping plate 229 to be moveable axially with respect to the first clamping face 224 and to facilitate removal of the inner clamping shoe 221 from the jig when required.

The upper face of the inner clamping plate 229 is formed to provide a channel like space in opposed relation to the inner clamping shoe 221. The channel like space accommodates a set of three rollers 235 which extend between the flanges defining the channel like space. The upper periphery of the rollers 235 extend beyond the upper edge of the flanges such that when the inner clamping shoe 221 is located on the clamping plate 229 the rollers enable axial relative movement between the inner clamping shoe 221 and the clamping plate 229. The inner lateral face of the inner clamping shoe 221 defines an upstanding rib which is intended to define the position of the innermost ends of the tubes 213 supported on the inner clamping shoe 221 and which in use will be received in the axial groove 226 of the outer clamping shoe 223 together with the head portion of the tube located adjacent the rib.

The face of the inner clamping plate 229 which is in opposed relation to the channel like space is provided with a set spigots 234, 236 and 238 which are intended to be received in correspondingly shaped sockets provided in the base of the recess 218 in order to positively locate the inner clamping plate 229 in the mandrel 215 and to enable relative movement between the inner clamping plate 229 in the mandrel 215 in a direction corresponding to the central axes of the spigots 234, 236 and 238. A drive (not shown) is provided within the body which cooperates with spigots to cause the spigots to move axially within the sockets to cause the moveable clamping member to move between a clamped relationship and an unclamped relationship with the fixed clamping member.

A further drive (not shown) is provided within the body whereby the drive shaft 214 is capable of axial movement relative to the mandrel 215 and as a result of such movement the inner clamping shoe 221 is moved axially with respect to the outer clamping shoe 221 when the clamping surfaces 224 and 228 are in clamping engagement to cause the controlled rotation of the needles about their respective central axes to facilitate the forming of a plurality of facets.

In use of the jig the inner clamping shoe 221 is removed from each clamping section 217 and is loaded with a set of tubes 213. The tubes can be retained in position by utilisation of a suitable adherent strip 232 which will serve to retain the needle blanks in position relative to each other and on the inner clamping shoe 221 while the inner clamping shoe 221 is being located in the jig and then subsequently removed from the jig. However the adherent will allow rotation of the needle blanks over the surface of the needle shoe as a result of relative axial displacement between the clamping surfaces. The adherent may be provided by an adhesive tape onto which the needle blanks can be located and which can be cut to length such that a set of needle blanks are located on the needle shoe. Another form of adherent can comprise a gel or the like which can be applied to the needle shoe in order to retain the needle blanks in position or any other suitable form of adherent. Once the inner clamping shoe 221 has been loaded it is then located in position on a retracted inner clamping plate 229 which is the moved such that the clamping faces 224 and 228 clamping receive the tubes 213 between them. The innermost ends of the tubes 213 are received against the axial rib provided at the inner lateral face of each inner clamping shoe 221 and in the axial recess 226 provided at the inner lateral edge of the first clamping face 224.

Once all of the clamping sections have been loaded with tubes, the jig can then be located on a drive member which supports the drive shaft 214 to effect rotation of the jig. The jig is associated with a suitable grinding element which can comprise a cylindrical grinding wheel similar to that described in relation to the first embodiment whereby the axis of rotation of the jig is parallel to the axis of rotation of the grinding wheel and is as a result of dual rotation of both the grinding wheel and the jig all of the tubes located at the clamping sections 217 on the jig can be faced as desired. If it is necessary to produce a number of facets to define the points of the needles this can be effected by axial displacement of the shaft 214 to cause axial displacement of the inner clamping shoe 221.

In use the rotation of the jig in association with the rotation of the grinding wheel increases the amount of material which can be removed from the tubes in order to provide an initial surface. The jig can then be indexed past the grinding wheel such that the tubes at each station can be indexed past the grinding wheel in order to finish and grind the primary facets of all of the tubes supported by the jig. On formation of the primary facets the relative axial displacement of the inner clamping shoe 221 will rotate the tubes to a position them for subsequent facet grindings. Once the further facets have been formed on the tubes supported at any one station the jig can then be indexed to locate the adjacent station in proximity with the grinding wheel.

It is anticipated that all motions of the tubes within the jig can be effected concurrently or sequentially with the movement of the stations relative to the grinding wheel. For example if the tubes are reciprocated about their central axes whilst the jig is spinning, a spherical form or part spherical form (depending upon the amount of displacement of the tubes) can be produced. By varying the reciprocation speed and displacement of the yoke coupled with different reciprocation speed of the grinding wheel compound spherical geometries can be created. This can be coupled with the relieving characteristic (in and out movement of the grinding wheel) timed in accordance with rotation of the jig to produce extremely complex spherical curves. This can be carried out on a simple CNC cylindrical grinder. In addition it is anticipated that a multiple of jigs can be mounted to a common shaft and associated with separate grinding wheels whereby it is possible to simultaneously grind the tubes in each of the jigs. Furthermore it is anticipated if the grinding wheels are dressed to a taper to each side of the centre line of the wheel it is possible to remove more material from the needle in a single traverse of the needle across the grinding wheel.

Figure 22:
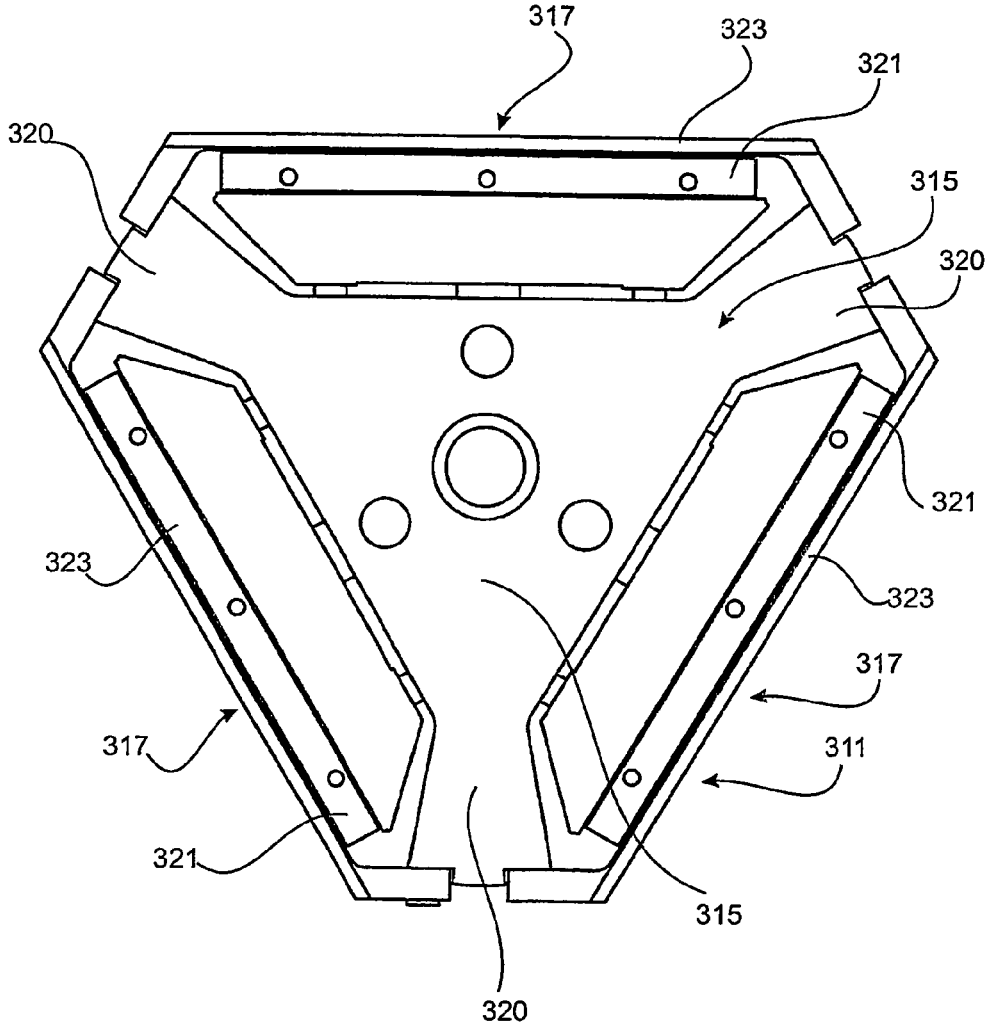
FIG. 22 is an end elevation of a rotary jig according to the third embodiment of the present invention.
Figure 23:
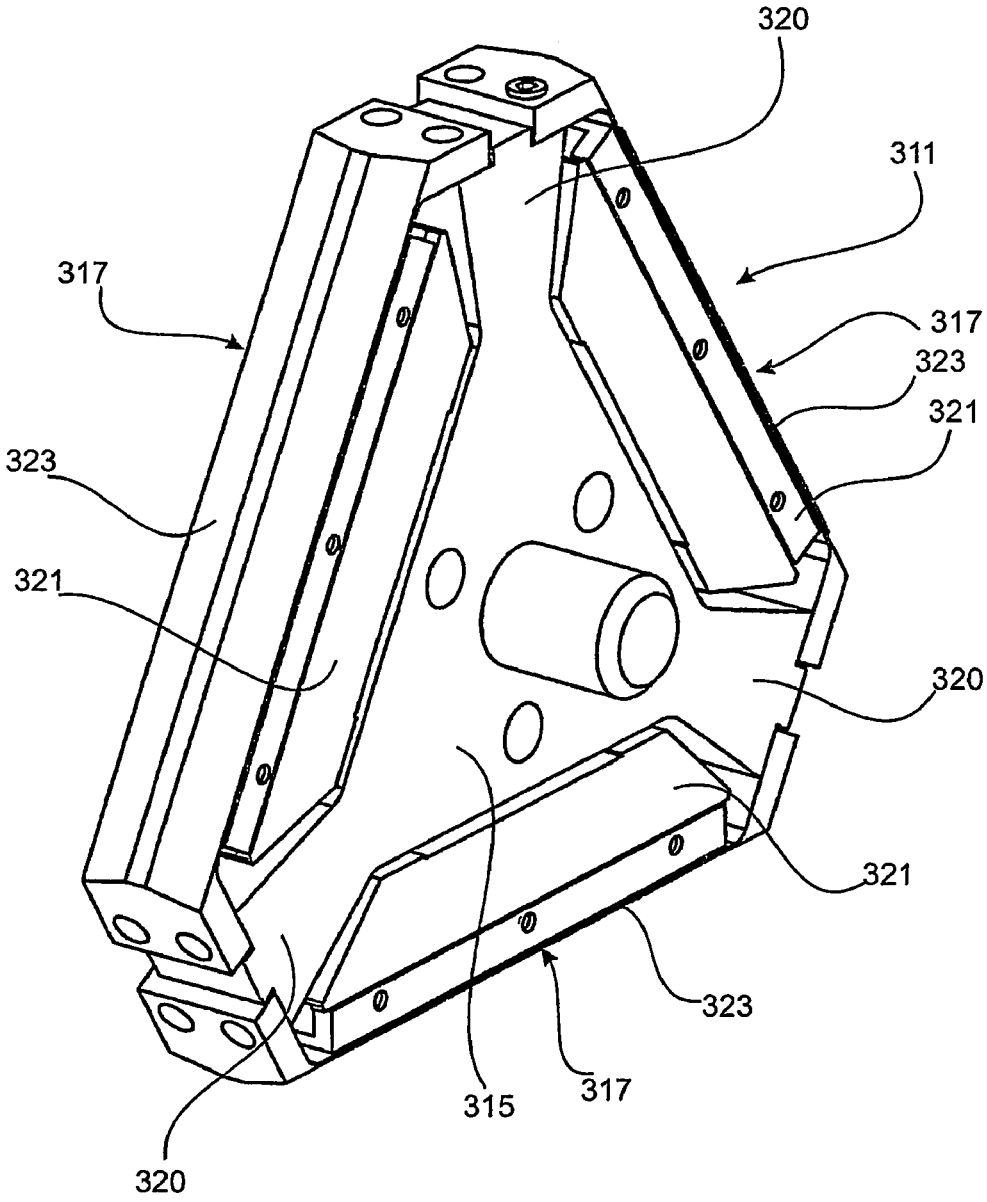
FIG. 23 is an isometric view of the rotary jig of FIG. 22.
Figure 24:
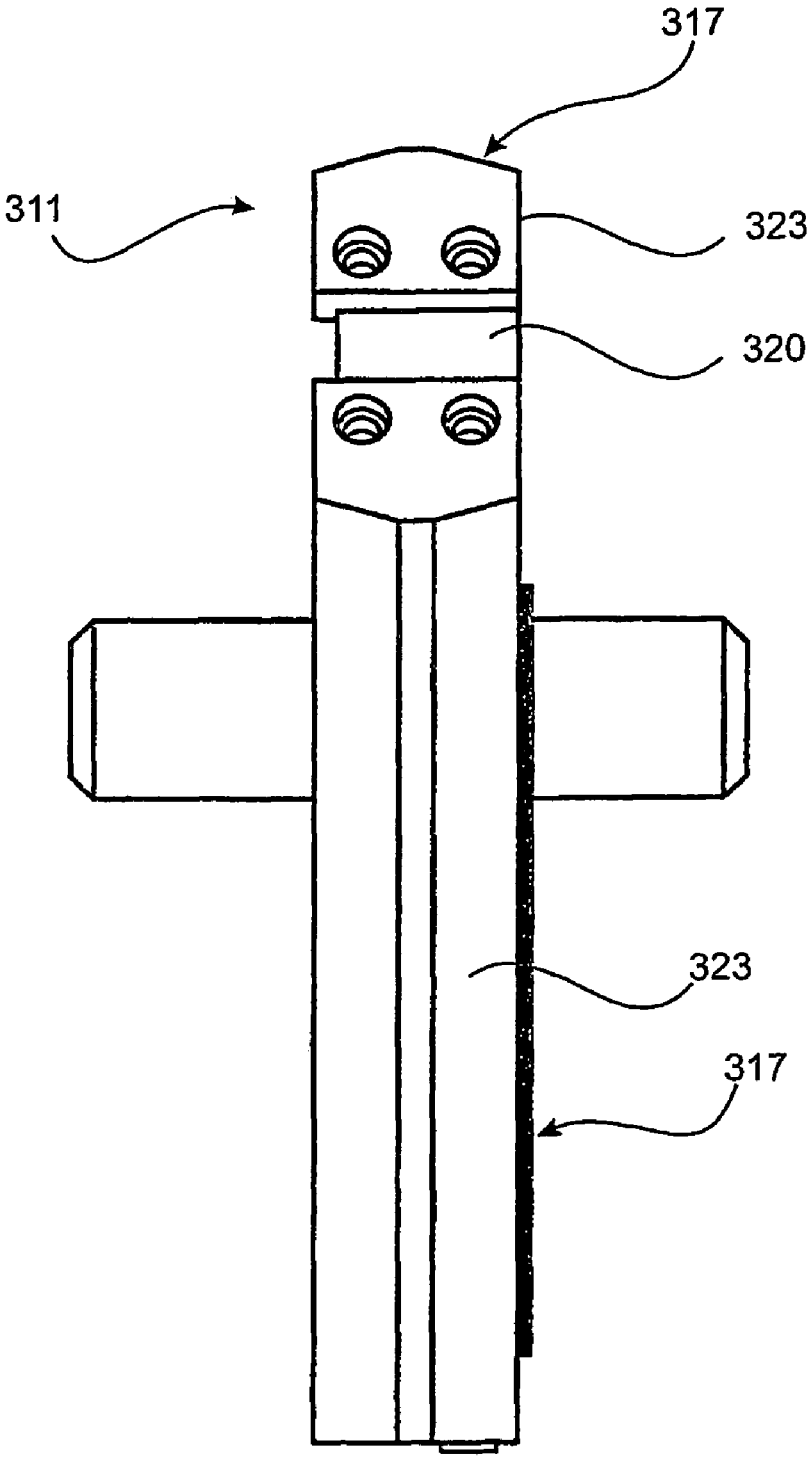
FIG. 24 is a side elevation of the rotary jig of FIGS. 22 and 23.

The third embodiment as shown at FIGS. 22 to 24 comprises a rotary jig 311 for holding tubes 313, of which at least one of the axial ends are to be ground to form hypodermic needles or blades.

The rotary jig 311 has a triangular shaped perimeter providing three angularly displaced clamping sections 317. The jig comprises a central mandrel 315 having a set of equiangularly displaced arms 320. Each face of the jig is defined by a clamping section 317 which extends between the arms 320 and each comprise an inner clamping shoe 321 and outer clamping shoe 323 with opposed parallel clamping surfaces which are parallel with the axis of rotation of the mandrel 315, and a clamping mechanism (not shown) supported from the mandrel which is actuable to displace the inner clamping shoe 321 radially outwardly and inwardly relative to the outer clamping shoe 323. The three outer clamping shoes 323 extend between the ends of three radially extending arms 320 of the mandrel 315 and may be connected to the outer ends of the radially extending arms 320 in any convenient manner. Each clamping mechanism comprises a set of clamping plates (not shown) which are to engage the inner clamping shoes 321 and which are associated with actuators (not shown) for causing displacement of the respective inner clamping shoe 321 radially outwardly and inwardly relative to the axis of rotation of the mandrel 315 and towards and away from the respective outer clamping shoe 323. In addition the inner clamping plate supports a set of rollers (not shown) which are located between the clamping plate and the inner clamping shoe to facilitate a longitudinal movement of the inner clamping shoe 321 relative to the clamping plate and the outer clamping shoe 323.

The clamping plates act to force the inner clamping shoes 321 towards the respective outer clamping shoes 323 so as to clamp the tubes 313 which had been previously loaded onto the inner clamping shoes 321 when removed from the rotary jig 311. To load the inner clamping shoes 321 into the rotary jig 311, the clamping plates are retracted inwardly towards the axis of rotation of the mandrel 315. The inner clamping shoes 321 with a set of tubes 313 adhered to their outer surfaces, and extending parallel to the axes of rotation of the jig 311, are then positioned in the mandrel. The actuators are then activated to drive the clamping plates radially outwardly and as a result force the inner clamping shoes 321 toward the outer clamping shoes 323, and thereby clamp a set of tubes 311 therebetween in preparation for machining.

While the rotary jig 311 of the above described third embodiment has a triangular configuration with three clamping sections other embodiments can have other polygonal shapes where each face is provided with one or more clamping sections.

According to an alternative embodiment of the invention the outer clamping shoes may be formed integrally with the mandrel.

While the rotary jig 11 according to each of the embodiments described above are particularly suited to the grinding of tubes for use as hypodermic needles, the use of the rotary jig according to each of the embodiments and the invention are not limited to the such. The rotary jig according to each of the embodiments and the invention can be used in processing of rod or tube-like members and can be used in association with any suitable grinding arrangement or an arrangement utilising any other applicable form of machining and grinding such as laser cutting, waterjet cutting, or milling.

The embodiments of the present invention have been described by way of example only and modifications and variations may be made without departing from the spirit and scope of the invention described.

Throughout the specification, unless the context requires otherwise, the word "comprise", and variations such as "comprises" or "comprising", will be understood to imply the inclusion of a stated step or integer or group of steps or integers but not the exclusion of any other step or integer or group of steps or integers.

The reference to any prior art in this specification is not, and should not be taken as, an acknowledgement or any form of suggestion that that prior art forms part of the common general knowledge in Australia.

The invention claimed is:

1. A jig intended in use to hold a series of blanks of rod-like or wire-like form during machining, said jig having a body adapted to be mounted to a drive shaft for rotation of the body about an axis of rotation, the body having a perimeter which on rotation of the jig defines a rotation path, the perimeter being defined by a set of stations located around the rotation path, each station having a pair of opposed clamping surfaces, one side of the clamping surfaces being located at the rotation path, in use the clamping surfaces being intended to receive between themselves a set of said blanks, one end of said blanks being positioned to extend outwardly from the one side to extend beyond the rotation path.

2. A jig as claimed at claim 1 wherein, two or more stations are arranged around the axis of the jig.

3. A jig as claimed at claim 1 wherein, the inner and outer clamping surfaces are provided by radially inner and outer clamping shoes.

4. A jig as claimed at claim 1 wherein the inner and outer clamping surfaces with the blanks clamped therebetween are capable of relative displacement between each other to thereby cause each blank to rotate about its axis to present a different part of the surface of the blank for machining.

5. A jig as claimed at claim 1 wherein the inner clamping surface is mounted within the jig for radial movement relative to the outer clamping surface to effect clamping of the blanks between the opposed clamping surfaces.

6. A jig as claimed at claim 5 wherein, the inner clamping surface is provided by an inner shoe and said inner shoe is displaceable radially to effect said clamping.

7. A jig as claimed at claim 5 wherein said inner shoe is removable from the jig to permit loading of the blanks onto the inner clamping surface.

8. A jig as claimed at claim 1 wherein the outer clamping surface is provided by an outer shoe and said outer shoe is displaceable radially to effect said clamping.

9. A jig as claimed at claim 8 wherein, the outer shoe is removable from the jig for loading with blanks onto the outer clamping surface.

10. A jig as claimed at claim 1 wherein the inner and/or outer shoes are capable of relative angular displacement with respect to each other to effect said clamping.

11. A jig as claimed at claim 1 wherein, the blanks are temporarily held to one or the other clamping surface during loading into the jig by being adhesively held to be retained thereon until the shoe has been loaded into the jig and clamping pressure is applied.

12. A jig as claimed at claim 1 wherein in use the jig is indexible by rotation about its axis to present successive blanks for machining.

13. A jig as claimed at claim 1 wherein each clamping surface has a pair of axially displaced opposed sides, where each side is associated with a rotation path.

14. A jig as claimed at claim 1 wherein the inner and outer clamping surfaces with the blanks clamped therebetween are capable of relative displacement relative to each other to thereby cause the rotation of each blank about its axis.

15. A jig as claimed at claim 14 wherein the surface jointly defined by the clamping surfaces is cylindrical whereby the axes of the blanks clamped therebetween will extend parallel to the axis of rotation of the jig.

16. A jig as claimed at claim 14 wherein the surface jointly defined by the clamping surfaces is part conical whereby the axes of the blanks clamped therebetween will have an inclination relative to the axis of rotation.

17. A jig as claimed at claim 14, wherein the inner clamping surface is capable of angular displacement relative to the outer clamping surface about the axis of rotation of the jig in order to effect the rotation of the blanks clamped between the two shoes, this rotation being about the axis of each respective blank.

18. A jig as claimed at claim 17 wherein the relative angular displacement between the clamping surfaces is effected jointly.

19. A jig as claimed at claim 17 wherein the relative angular displacement of one clamping surface is effected independently other clamping surface.

20. A jig as claimed at claim 1 wherein the jig has a perimeter of a polygonal form centred on the axis of rotation of the jig where each face is defined by having an inner and an outer clamping surfaces for clamping the blanks therebetween so that the blanks extend with their axis in the direction of the axis of rotation of the jig, the one side of each clamping surface located in a plane perpendicular to the axis and to one side of the jig, the rotation path residing in a further plane adjacent said plane, the jig in use being indexible by rotation about its axis to present the blanks on successive faces for machining.

21. A jig as claimed at claim 20 wherein the clamping surfaces are parallel to the axis of rotation whereby the axes of the blanks clamped therebetween will extend parallel to the rotation axis.

22. A jig as claimed at claim 20 wherein the clamping surfaces of the faces are convergent to jointly define a part pyramid like configuration whereby the axes of the blanks clamped in the jig will have an inclination relative to the axis of rotation of the jig.

23. A jig as claimed at claim 20 wherein, the clamping surfaces are supported in the jig to be capable of relative tangential displacement with respect to the axis of rotation of the jig and parallel to each other, in order to effect the rotation of the blanks clamped between the two shoes about the axis of each respective blank.

24. A jig as claimed at claim 23 wherein the relative tangential displacement between the clamping surfaces is effected jointly.

25. A jig as claimed at claim 23 wherein the relative tangential displacement of one clamping surface is effected independently other clamping surface.

26. A jig as claimed at claim 1 wherein said one side extends axially across the perimeter at each station.

27. A jig as claimed at claim 26 wherein the surfaces are inclined inwardly from the perimeter.

28. A jig as claimed at claim 26 wherein in use the blanks are to be supported between the clamping surface such that their main axes are parallel with a plane containing the rotation path.

29. A process for grinding facets on blanks for forming hypodermic needles, comprising loading the blanks into a rotary jig of the form as claimed at claim 1, indexing the jig by rotation about its axis to present successive blanks held thereby to a grinding wheel to grind one facet on the needle, and actuating the jig to cause rotation of each blank about its axis to facilitate grinding of another facet on the blank as each blank is successively presented to the grinding wheel upon indexing of the rotary jig.

30. A grinding system having a rotary jig as of the form as claimed at claim 1 and a grinding wheel, wherein the wheel is of elongate form and the jig is mounted for movement in a direction parallel to the axis of the wheel for reciprocatory movement along the length of the wheel, and the jig is also mounted for movement transversely relative to the axis of the wheel.

31. A grinding system, comprising a rotary jig as claimed at claim 1, and a grinding wheel mounted on a head which is movable relative to the jig to grind one end portion of each of the blanks projecting from the jig in a circular array.

32. A grinding system as claimed at claim 31 wherein the grinding wheel can approach the blanks from the outside of the array and/or from the inside of the array.

33. A grinding system as claimed at claim 31 wherein the head also carries a second grinding wheel locatable by movement of the head to grind a second end portion of the blanks carried by the rotary jig.

34. A jig intended in use to hold a series of blanks of rod-like or wire-like form during machining, said jig having a body adapted to be mounted to a drive shaft and having a perimeter which on rotation of the jig defines a rotation path, the perimeter being defined by a set of stations located at angularly spaced intervals around the rotation path, each station having a pair of opposed clamping surfaces said surfaces having one side located in the rotation path, said one side extending axially across the perimeter, the surfaces being inclined inwardly from the perimeter, in use the clamping surfaces being intended to receive a set of said blanks which are positioned such that their main axes are parallel with a plane containing the rotation path, in use the outer end of said blanks being positioned to extend outwardly from the one side to extend beyond the rotation path.

35. A jig as claimed at claim 34 wherein the clamping faces surfaces are capable of axial displacement relative to each other whilst in their clamping mode to cause rotation of the blanks about their central axis.

36. A jig as claimed at claim 34 wherein at least one of said clamping surfaces is defined by a removable shoe which is adapted to receive the set of blanks.

* * * * *